US008891989B2

(12) United States Patent
Umeda et al.

(10) Patent No.: US 8,891,989 B2
(45) Date of Patent: Nov. 18, 2014

(54) IMAGE FORMING APPARATUS

(75) Inventors: Kensuke Umeda, Yokohama (JP); Ken Nakagawa, Yokohama (JP); Tomoo Akizuki, Yokohama (JP); Kazuhiro Doda, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 391 days.

(21) Appl. No.: 13/427,289

(22) Filed: Mar. 22, 2012

(65) Prior Publication Data

US 2012/0243894 A1 Sep. 27, 2012

(30) Foreign Application Priority Data

Mar. 23, 2011 (JP) ..... 2011-064127

(51) Int. Cl.
*G03G 15/20* (2006.01)

(52) U.S. Cl.
CPC .. *G03G 15/2032* (2013.01); *G03G 2215/00721* (2013.01); *G03G 2215/00561* (2013.01); *G03G 2215/00603* (2013.01)
USPC ..... 399/68

(58) Field of Classification Search
CPC ..... G03G 15/2032; G03G 2215/00721; G03G 2215/00603
USPC ..... 399/68
See application file for complete search history.

(56) References Cited

U.S. PATENT DOCUMENTS

| | | | | |
|---|---|---|---|---|
| 4,958,195 | A * | 9/1990 | Firth et al. | 399/332 |
| 7,177,579 | B2 | 2/2007 | Uchida et al. | |
| 7,283,763 | B2 | 10/2007 | Akizuki et al. | |
| 7,512,370 | B2 | 3/2009 | Shimizu et al. | |
| 2005/0025511 | A1 * | 2/2005 | Watabe | 399/67 |
| 2007/0014585 | A1 * | 1/2007 | Nagasu et al. | 399/67 |
| 2013/0336687 | A1 * | 12/2013 | Monahan et al. | 399/325 |

FOREIGN PATENT DOCUMENTS

JP 2010-026449 A 2/2010

* cited by examiner

*Primary Examiner* — David Gray
*Assistant Examiner* — Tyler Hardman
(74) *Attorney, Agent, or Firm* — Fitzpatrick, Cella, Harper & Scinto

(57) ABSTRACT

An image forming apparatus includes an image forming station for forming a toner image on a sheet; an image heating portion including a flexible heating roller and a pressing roller to form a nip, the image heating portion being effective to heat while feeding the sheet, by the nip; a pressing state switching portion for switching a state of the nip between a pressing state and a released state; and a sheet feeding position detector for detecting misalignment of the sheet relative to a feeding reference position with respect to a direction perpendicular to a feeding direction of the sheet; wherein when the sheet feeding position detector detects the misalignment, the pressing state switching portion permits the nip to feed at least one sheet in a state of the misalignment, and then switches the nip to the released state and then switches to the pressing state.

6 Claims, 15 Drawing Sheets

IMAGE FORMING APPARATUS

FIELD OF THE INVENTION AND RELATED ART

The present invention relates to an image forming apparatus which forms an image on recording medium with the use of an image formation process, such as an electrophotographic image formation process, an electrostatic image formation process, and the like, that are suitable for the recording medium and the image to be formed.

There are various image forming apparatuses for forming an image on a recording medium, for example, a copying machine, a printer (laser printer, LED printer, for example), a facsimile machine, a machine capable of performing two or more functions of the preceding machines, etc.

An image forming apparatus uses an image heating device, which is a fixing device for heating the unfixed image on recording medium to fix the unfixed image to the recording medium, or an apparatus (image quality altering device) for heating the fixed image on recording medium to increase the glossiness of the fixed image.

Some of the conventional image heating devices employed by an electrophotographic image forming apparatus, for example, use a film (endless belt of film), which is circularly driven while being kept pressed upon the recording medium and the image thereon to be heated. If a sheet of a recording medium is conveyed through any of these image heating devices so that the center of the sheet of the recording medium does not align with the center of the recording medium passage of the heating device, the film, which is a rotational heating member of the device, is sometimes damaged, for the following reason. The abovementioned thermal fixing method is a thermal fixing method that employs a film (belt) which is driven by a rotational pressure roller kept pressed upon the film. Further, the abovementioned "off-center sheet conveyance" means that when a sheet of a recording medium is conveyed through the fixing device of an image forming apparatus, the center of the sheet is not in alignment with the center of the recording medium passage of the fixing device in terms of the direction perpendicular to the recording medium conveyance direction.

When a sheet of a recording medium is conveyed through an image heating device, the pressure roller of the heating device, which is a pressure applying rotational member, receives heat from the heat applying rotational member (film), and is made to expand by the heat. However, when a sheet of a recording medium is conveyed off-center, the heat from the rotational heating member is not absorbed by the sheet of the recording medium, in the area of the recording medium passage, which is outside the path of the sheet of the recording medium. Thus, the portion of the pressure roller that is outside the path of the sheet of the recording medium, becomes higher in temperature than the portion of the pressure roller inside the path of the sheet of the recording medium. Therefore, the former becomes different in the amount of thermal expansion from the latter. The thermal expansion of the former increases the former in external diameter, making the former different in external diameter from the latter.

The fixation film is rotated by the friction generated between the fixation film and the pressure roller as the pressure roller is rotated. Therefore, if the portion of the pressure roller, which is in the path of the sheet of the recording medium, becomes different in diameter from the portion of the pressure roller that is outside the path of the sheet of the recording medium, the former becomes different in fixation film conveyance speed from the latter, generating such a force that works in a direction to twist the fixation film in the rotational direction of the film. If the amount by which the film is twisted exceeds a certain value, such a problem sometime occurs that the film becomes permanently changed in shape, or damaged.

One of the solutions to the above-described problem is disclosed in Japanese Laid-open Patent Application 2010-026449. According to this application, the thermal fixing device is structured so that if it is detected that a sheet of a recording medium is being conveyed off-center, the recording medium feed interval is extended (that is, the image forming apparatus is reduced in throughput) to allow the pressure roller to reduce the amount of nonuniformity in external diameter attributable to the thermal expansion of the pressure roller.

In the case of the structural arrangement for an image heating device which is disclosed in the abovementioned document, the temperature difference between the portion of the pressure roller outside the recording medium path, and the portion of the pressure roller inside the recording medium path, is reduced by the heat radiation from the portion of the pressure roller outside the recording medium path. As for the means for increasing the amount of heat radiating from the portion of the pressure roller outside the recording medium path, the interval with which sheets of the recording medium are put through the fixing device is extended. As the difference in temperature between the portion of the pressure roller outside the recording medium path, and the portion of the pressure roller inside the recording medium path, decreases, the amount of force that works in the direction to twist (distort) the film decreases. Thus, the film untwists itself by its own resiliency, preventing itself from being damaged.

SUMMARY OF THE INVENTION

However, the structural arrangement disclosed in the abovementioned document has a problem in that the film is allowed to untwist itself simply by allowing the portion of the pressure roller outside the recording medium path, to naturally decrease in temperature, and therefore, it substantially reduces the productivity of the image forming apparatus.

Therefore, the primary object of the present invention is to provide an image forming apparatus which allows the heating film of its image heating device to quickly untwist itself, and therefore, is not significantly reduced in productivity by the process for allowing the film to untwist itself to prevent the film from being damaged.

According to an aspect of the present invention, there is provided an image forming apparatus comprising: an image forming station for forming a toner image on a recording material; an image heating portion including a flexible heating rotatable member and a pressing rotatable member press-contacted to the heating rotatable member to form a nip, the image heating portion being effective to heat while feeding the recording material, by the nip; a pressing state switching portion for switching a state of the nip between a pressing state and a released state; and a recording material feeding position detector for detecting misalignment of the recording material relative to a feeding reference position with respect to a direction perpendicular to a feeding direction of the recording material in the image forming apparatus. When the recording material feeding position detector detects the misalignment, the pressing state switching portion permits the nip to feed at least one recording material in a state of the misalignment, and then the pressing state switching portion switches the nip to the released state and then switches to the pressing state.

These and other objects, features, and advantages of the present invention will become more apparent upon consideration of the following description of the preferred embodiments of the present invention, taken in conjunction with the accompanying drawings.

BRIEF DESCRIPTION OF THE DRAWINGS

FIG. 9(*b*) is a diagram which shows the positional relationship between a sheet of the recording medium and the recording medium passage of the fixing device in accordance with the present invention when the sheet P is being conveyed off-center leftward through the fixing device; and FIG. 9(*c*) is a diagram which shows the positional relationship between a sheet of the recording medium and the recording medium passage of the fixing device in accordance with the present invention, when the sheet P is being conveyed off-center rightward.

DESCRIPTION OF THE PREFERRED EMBODIMENTS

[Embodiment 1]

(1) General Description of Image Forming Apparatus

Figure 1:
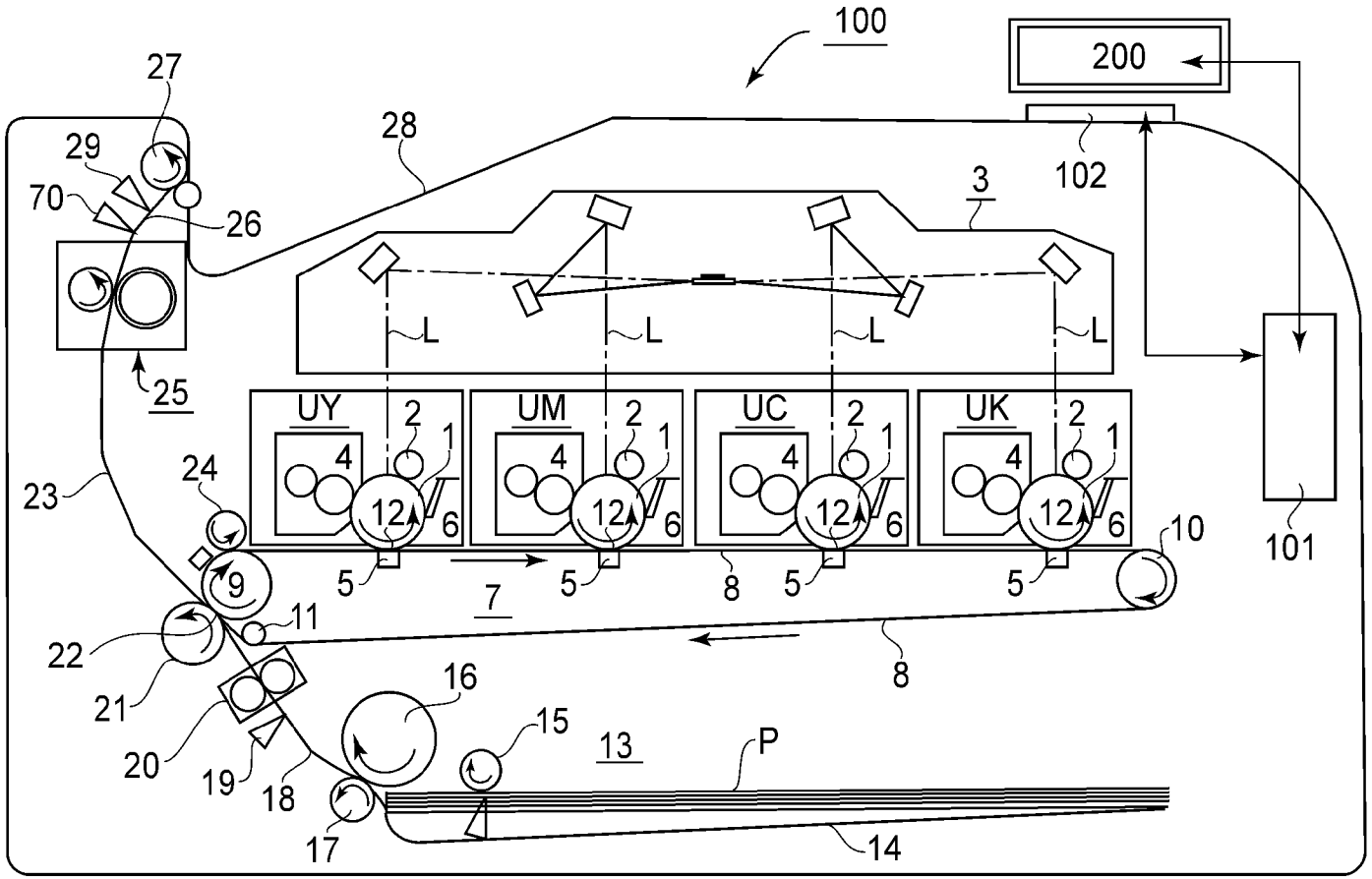
FIG. 1 is a schematic sectional view of an example of an image forming apparatus, the image fixing device of which is an image heating device in accordance with the present invention; it shows the general structure of the apparatus.

FIG. 1 is a schematic sectional view of the image forming apparatus 100 in this embodiment, the fixing device 25 of which is an image heating apparatus in accordance with the present invention. It shows the general structure of the apparatus 100.

This image forming apparatus 100 is of the so-called inline (tandem) type, and also, of the so-called intermediary-transfer type. More specifically, it is an electrophotographic full-color laser printer. It has multiple (four) image formation stations UY, UM, UC, and UK, each of which has an image bearing member 1. When it is in the full-color mode, it forms multiple (four) monochromatic toner images, different in color, with the use of its multiple (four) image formation stations, one for one, and synthetically forms a full color image by layering the four monochromatic toner images. It forms a full-color toner image on a sheet P of a recording medium, based on the image data (image information: electrical image formation signals) inputted into the controller 101 of the image forming apparatus 100 from an external apparatus 200 (host apparatus), such as a host computer, an image reader, a facsimile machine, etc. The sheet P of the recording medium is a sheet of any medium on which an image can be formed by the apparatus 100.

The controller section 101 is capable of exchanging various electrical information with the external apparatus 200 and the control panel 102 of the image forming apparatus 100. Further, it integrally controls the image forming operation of the apparatus 100 according to a preset control program and reference tables. Thus, the control panel 102 is provided with various keys, displays, etc., which can be used by an operator to set desired image formation conditions, or the like, or input them into the controller 101.

Referring to FIG. 1, the apparatus 100 has multiple (four) image formation stations U, which are different in the color of the monochromatic images they form. The image formation stations U are in alignment in parallel (tandem placement) from left to right in the drawing. More specifically, the four image formation stations U are the first to fourth image formation stations UY, UM, UC and UK which form yellow (Y), magenta (M), cyan (C) and black (K) monochromatic images, respectively.

Each of the four image forming stations U is an electrophotographic image formation mechanism, and uses an exposing method which uses a scanning beam of laser light. The four image formations U are the same in structure although they are different in the color of the developer stored in the developing device 4 of each station U. Each image formation station U has an electrophotographic photosensitive member 1 (which hereafter will be referred to simply as drum 1) as the first image bearing member, which is in the form of a drum. The drum 1 is rotated in the counterclockwise direction, indicated by an arrow mark, by a driving means (unshown), at a preset peripheral velocity.

Each image formation station U has also electrophotographic processing devices for processing the drum 1, which are adjacent to the drum 1. The electrophotographic processing devices in this embodiment are a charge roller 2, a developing device 4, a primary transferring member 5, and a drum cleaner 6. The image forming apparatus 100 has also a laser scanner 3 as an exposing means, which is above the cluster of the four image formation stations U. Further, the apparatus 100 has an intermediary transfer belt unit 7, which is below the cluster of the four image formation stations U.

To the charge roller 2, a preset charge bias is applied from an electric power source (unshown). As the preset bias is applied to the charge roller 2, the charge roller 2 uniformly charges the peripheral surface of the drum 1 to a preset polarity and a potential level. The scanner 3 has a semiconductor laser, a rotational polygonal mirror, an f-θ lens, a deflection mirror, etc. As the drum 1 is rotated, the scanner 3 scans the uniformly charged portion of the peripheral surface of the drum 1 with the beam L of laser light it emits while modulating (turning on or off) the beam of laser light according to the information of one of the monochromatic optical images, or equivalents thereof, obtained by separating a color image (original). As the uniformly charged portion of the drum 1 is exposed by the scanner 3, an electrostatic latent image (electrostatic image), which reflects the pattern of exposure of the peripheral surface of the drum 1, is effected on the uniformly charged portion of the peripheral surface of the drum 1.

The developing device 4 develops the electrostatic latent image on the peripheral surface of the drum 1, into a visible image, that is, an image formed of toner, which hereafter may be referred to simply as a toner image. The color of the toner of the developer stored in the developing device 4 of the first image formation station UY is yellow (Y), and the color of the toner of the developer stored in the developing device 4 of the second image formation station UM is magenta (M). The color of the toner of the developer stored in the developing device 4 of the third image formation station UC is cyan (C), and the color of the toner of the developer stored in the developing device 4 of the fourth image formation station UK is black (K).

The unit 7 has an intermediary transfer belt 8, which is an intermediary transferring member (second image bearing member). The belt 8 is endless, and is flexible. It is supported and kept stretched by three belt supporting rollers, that is, a second transfer counter roller 9, a tension roller 10, and a follower roller 11. The secondary transfer counter roller 9 doubles as a belt driving roller.

In terms of the moving direction of the belt 8, the roller 9 is on the upstream side of the first image formation station UY, and the roller 10 is on the downstream side of the fourth image formation station UK. The roller 11 is on the underside of the roller 9. As the roller 9 is rotated by a driving means (unshown), the belt 8 is circularly moved by the roller 9 in the clockwise direction, indicated by an arrow mark, at roughly the same speed as the peripheral velocity of the drum 1. The rollers 10 and 11 are rotated by the circular movement of the belt 8 which is circularly moved by the roller 9.

The unit 7 has also four primary transferring members, that is, the first to fourth primary transferring members 5. Each primary transferring member 5 is on the inward side of the loop which the belt 8 forms, and opposes the drum 1 of the corresponding image formation station U. In terms of the moving direction of the belt 8, the four primary transferring members 5 are between the rollers 9 and 10, and are parallel to each other. That is, each primary transferring member 5 is kept pressed against the downwardly facing portion of the peripheral surface of the corresponding image formation station U, with the presence of the belt 8 between the primary transferring member 5 and drum 1. The area of contact between the peripheral surface of the drum 1 in each image formation station U, and the belt 8, is the primary transfer nip 12, in which an image is transferred from the drum 1 onto the belt 8.

Against the roller 9, a secondary transfer roller 21 is kept pressed, with the presence of the belt 8 between the roller 9 and roller 21. The area of contact between the belt 8 and roller 21 is the secondary transfer nip 22. The roller 21 is rotated by the circular movement of the belt 8.

The above-described portions of the image forming apparatus 100 are the image formation stations which form a full-color image (unfixed image) on a sheet P of the recording medium as the sheet P is conveyed through the recording medium conveyance passage. The operation for forming a full-color image on a sheet P of the recording medium is as follows: First, electrical signals, which reflect the information of a full-color image to be formed, are inputted into the controller 101 of the image forming apparatus 100 from the external apparatus. As the electrical signals are inputted, the controller 101 begins to rotate the drum 1 of each of the first to fourth image formation stations UY, UM, UC, and UK, and starts an image-forming-operation sequence with a preset control timing. Also, it starts driving the roller 9 of the unit 7, whereby the belt 8 is rotated.

In the first image formation station UY, a monochromatic yellow toner image, which corresponds to the yellow monochromatic image, which is one of the monochromatic images into which a full-color image to be formed has been separated, is formed on the peripheral surface of the drum 1 with a preset control timing. In the second image formation station UM, a monochromatic magenta toner image, which corresponds to the monochromatic magenta image, which is one of the monochromatic images into which a full-color image to be formed has been separated, is formed on the peripheral surface of the drum 1 with a preset control timing. In the third image formation station UC, a monochromatic magenta toner image, which corresponds to the magenta monochromatic image, which is one of the monochromatic images to which a full-color image to be formed has been separated, is formed on the drum 1 with a preset control timing. In the fourth image formation station UK, a monochromatic black toner image, which corresponds to the black monochromatic image, which is one of the monochromatic images into which a full-color image to be formed has been separated, is formed on the drum 1 with a preset control timing.

In the primary transfer nip 12 of the first image formation station UY, the monochromatic yellow (Y) toner image on the drum 1 is transferred (primary transfer) onto the circularly moving belt 8. In the primary transfer nip 12 of the first image formation station UM, the monochromatic magenta (M) toner image on the drum 1 is transferred (primary transfer) onto the circularly moving belt 8 so that it is layered on the yellow toner image on the belt 8. In the primary transfer nip 12 of the third image formation station UC, the monochromatic cyan (C) toner image on the drum 1 is transferred (primary transfer) onto the circularly moving belt 8 so that it is layered on the yellow (Y) and magenta (M) toner images on the belt 8. In the primary transfer nip 12 of the first image formation station UK, the monochromatic black (B) toner image on the drum 1 is transferred (primary transfer) onto the circularly moving belt 8 so that it is layered on the yellow (Y), magenta (M) and cyan (C) toner images on the belt 8.

More specifically, for the above described primary transfer, a preset primary transfer bias, which is opposite in polarity to the intrinsic toner polarity, is applied to the primary transferring member 5. As the primary transfer bias is applied to the primary transferring member 5, the toner image on the drum 1 is electrostatically transferred onto the belt 8. Consequently, four monochromatic toner images, different in color, that is, yellow (Y), magenta (M), cyan (C) and black (K) monochromatic toner images, are sequentially transferred in layers onto the belt 8, effecting thereby an unfixed full-color toner image (multicolor toner image) on the belt 8.

The unfixed full-color toner image on the belt 8 is conveyed to the secondary transfer nip 22 by the continuous circular movement of the belt 8. After the primary transfer of a toner image onto the belt 8 in each of the image formation stations U, the peripheral surface of the drum 1 is cleaned by the drum cleaner 6; the residues, such as the toner particles, remaining on the peripheral surface of the drum 1 after the primary transfer are removed by the drum cleaner 6 so that the peripheral surface of the drum 1 can be repeatedly used for image formation.

Meanwhile, the controller 101 rotates a pickup roller 15 of the sheet feeding section 13, which is for feeding, one by one, the stacked sheets P of recording medium on the sheet feeding means 14 of the sheet feeding section 13, into the main assembly of the image forming apparatus 100. The sheet feeding means 14 is in the bottom portion of the main assembly of the apparatus 100. It is in the form of a multipurpose tray having the movable side guides, or a sheet feeder cassette.

As the pickup roller 15 is rotated, the topmost sheet P of the recording medium in the sheet feeding means 14 is fed into the main assembly of the image forming apparatus 100, and is introduced into the nip between a sheet conveyance roller 16 and a retard roller 17, so that the sheet P, or sheets P, of the recording medium, which are under the topmost sheet P, are prevented from being conveyed with the topmost sheet P. Thus, only the topmost sheet P is fed into the main assembly of the apparatus 100 while being separated from the rest, and is sent into the recording medium conveyance passage 18, which leads to the secondary transfer nip 22.

As the sheet P of the recording medium is sent into the recording medium conveyance passage 18, it comes into contact with a registration sensor 19, and turns on the sensor 19. Then, the leading edge of the sheet P comes into contact with the nip between a pair of registration rollers 20, and is caught by the nip. At the point in time when the sheet P comes into contact with the nip, the registration rollers 20 are kept stationary. Then, the registration rollers 20 begin to be driven with a preset control timing (registration timing), whereby the sheet P is sent forward from the nip by the registration rollers 20, and then, is introduced into the nip 22.

Not only do the pair of registration rollers 20 play the role of correcting in attitude the sheet P of the recording medium before the sheet P is introduced into the nip 22, but also, the rollers 22 play the role of synchronizing the conveyance of the sheet P with the progression of the toner image formation on the belt 8. That is, as the sheet P is conveyed to the pair of registration rollers 20, the leading edge of the sheet P comes into contact with the nip between the registration rollers 20 which are kept stationary. Thus, if the sheet P happens to be askew, it is corrected in attitude by the contact between the leading edge of the sheet P and the nip between the registration rollers 20. Then, the registration rollers 20 begin to be rotated to convey the sheet P forward with such a timing that the printing start line of the sheet P reaches the nip 22 at the same time as the leading edge of the unfixed full-color toner image on the belt 8.

As the sheet P reaches the nip 22, it is conveyed through the nip while remaining pinched by the secondary transfer roller 21 and belt 8. While the sheet P is conveyed through the nip 22, a preset secondary transfer bias, which is opposite in polarity to the intrinsic polarity of toner, is applied to the roller 21 from an electric power source (unshown), whereby the layered and unfixed multiple (four) monochromatic toner images, different in color, which make up an unfixed full-color toner image on the belt 8, are electrostatically transferred together (secondary transfer) onto one of the surfaces of the sheet P as if they are peeled away from the belt 8.

After being conveyed out of the nip 22, the sheet P of the recording medium is separated from the belt 8, and is introduced into the fixing device 25 through a recording medium conveyance passage 23. In this embodiment, the secondary transfer residual toner, that is, the toner remaining on the belt 8 after the separation of the sheet P from the belt 8, is charged by a residual toner charge roller 24 to a preset polarity, and is conveyed further by the belt 8. Then, it is transferred back onto the peripheral surface of the drum 1, primarily in the nip 12 of the first image formation station UY, and then, is removed from the peripheral surface of the drum 1 by the drum cleaner 6.

As the sheet P of the recording medium is introduced into the fixing device 25, it is conveyed through the fixation nip of the device 25 while remaining pinched by the nip, whereby the unfixed toner image on the sheet P is subjected to heat and pressure, being thereby fixed, as a solid image, to the sheet P. After being conveyed out of the fixing device 25, the sheet P is conveyed through a recording medium conveyance passage 26, which leads to a pair of discharge rollers 27. Then, it is discharged by the pair of discharge rollers 27 into a delivery tray 28 which makes up a part of the top portion of the image forming apparatus 100. The recording medium conveyance passage 26 is provided with a sheet width detection sensor 70 and a sheet sensor 29, which are positioned in the listed order in terms of the recording medium conveyance direction.

Figure 2:
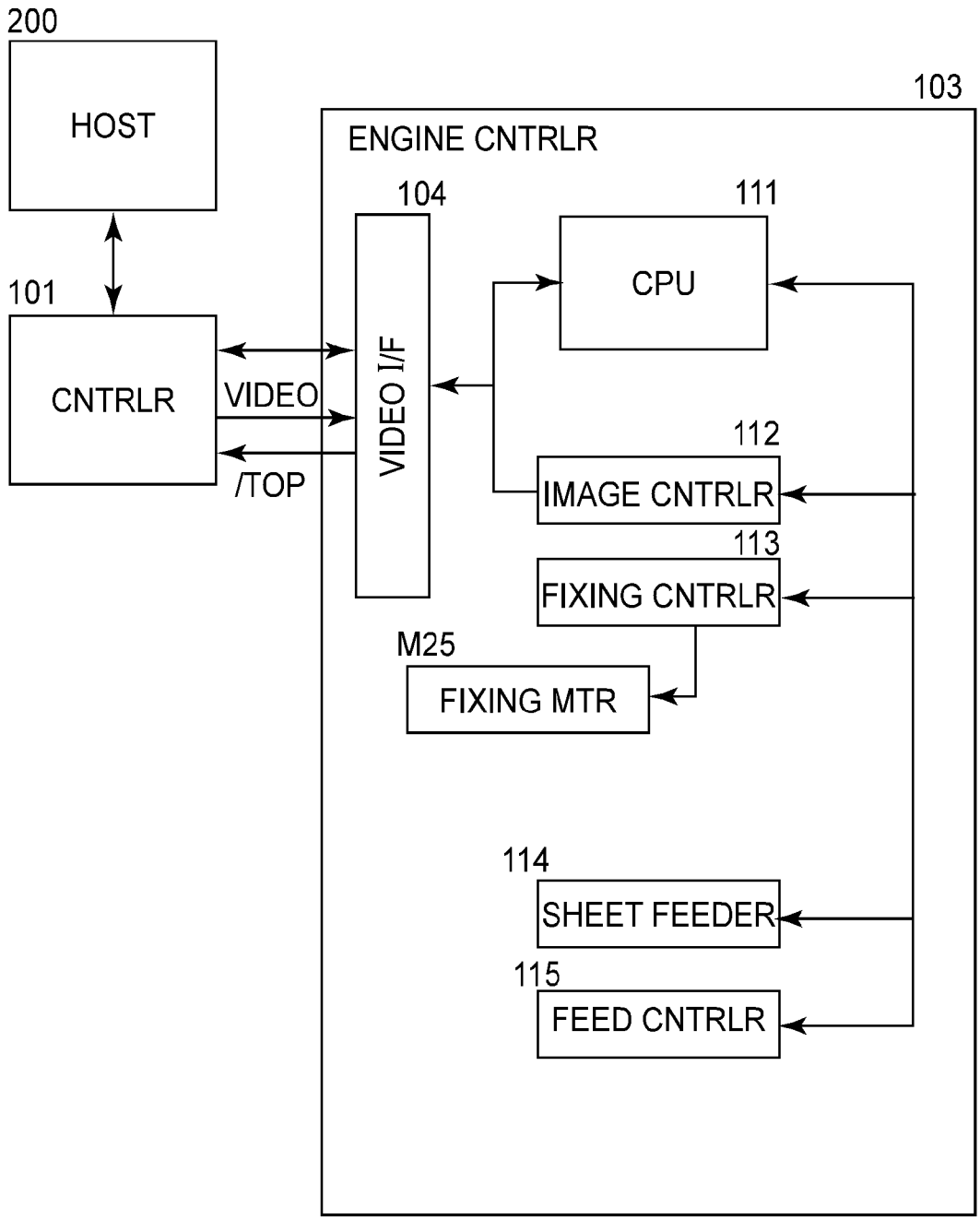
FIG. 2 is a block diagram of the image formation system of the image forming apparatus in accordance with the present invention; it shows the general structure of the system.

FIG. 2 is a block diagram for describing the system structure of the image forming apparatus 100. The controller 101 is capable of communicating with the host computer 200 (external apparatus) and an engine control section 103 of the apparatus 100. It receives image information and print commands from the host computer 200, and converts the received image information into bit data by analyzing the information. Then, it sends a print reservation command, print start commands, and video signals to the engine control section 103 through the video interface 104, per sheet of the recording medium.

Further, the controller 101 sends the print reservation command to the control section 103 in response to the print command from the host computer 200. Then, as the image forming apparatus 100 becomes ready for printing, the controller 101 sends the print start command to the control section 103. As the control section 103 receives the printing instruction, it begins a printing operation by outputting to the controller 101 TOP signals, which are the reference timing for outputting the video signals. As the control section 103 starts the printing operation, it carries out image forming operations necessary for the printing operation, by controlling the CPU 111, an image processing section 112, a fixation controlling section 113, a recording medium conveyance section 114, and a sheet feed control section 115.

(2) Fixing Device 25

In the following description of the fixing device 25, the front side of the fixing device 25 is the recording medium entrance side of the fixing device 25, and the rear side of the fixing device 25 is the opposite side (recording medium outlet side) from the front side. The left and right sides of the fixing device 25 are the left and right sides of the fixing device 25 as seen from the front side of the device 25. The widthwise direction of the structural members of the fixing device 25 and apparatus 100 is the direction parallel to the direction perpendicular to the recording medium conveyance direction in each of the recording medium conveyance passages.

The upstream and downstream sides are the upstream and downstream sides in terms of the recording medium conveyance direction. With regard to the measurements of a sheet P of the recording medium, the "sheet width" or "sheet path width" means the measurement of the sheet P of the recording medium, and the measurement of sheet path, in terms of the direction perpendicular to the recording medium conveyance passage. The "maximum sheet path width" equals the width of the widest sheet P of the recording medium conveyable through the image forming apparatus 100.

Regarding the positional relationship between a sheet P of the recording medium and the image forming apparatus 100 and fixing device 25 when the sheet P is conveyed through the apparatus 100 and device 25, the sheet P is conveyed so that the widthwise center of the sheet P coincides with the widthwise center of the recording medium conveyance passage of the apparatus 100 and that of the device 25. That is, the image forming apparatus 100 and the fixing device 25 are structured so that as the sheet P is fed into the apparatus 100 and fixing device 25, it is conveyed so that the widthwise centerline of the sheet P becomes and remains virtually aligned with the widthwise centerline of the recording medium conveyance passage of the apparatus 100 and that of the device 25, regardless of the recording medium sheet width, that is, whether the sheet P is wide or narrow.

Figure 3:
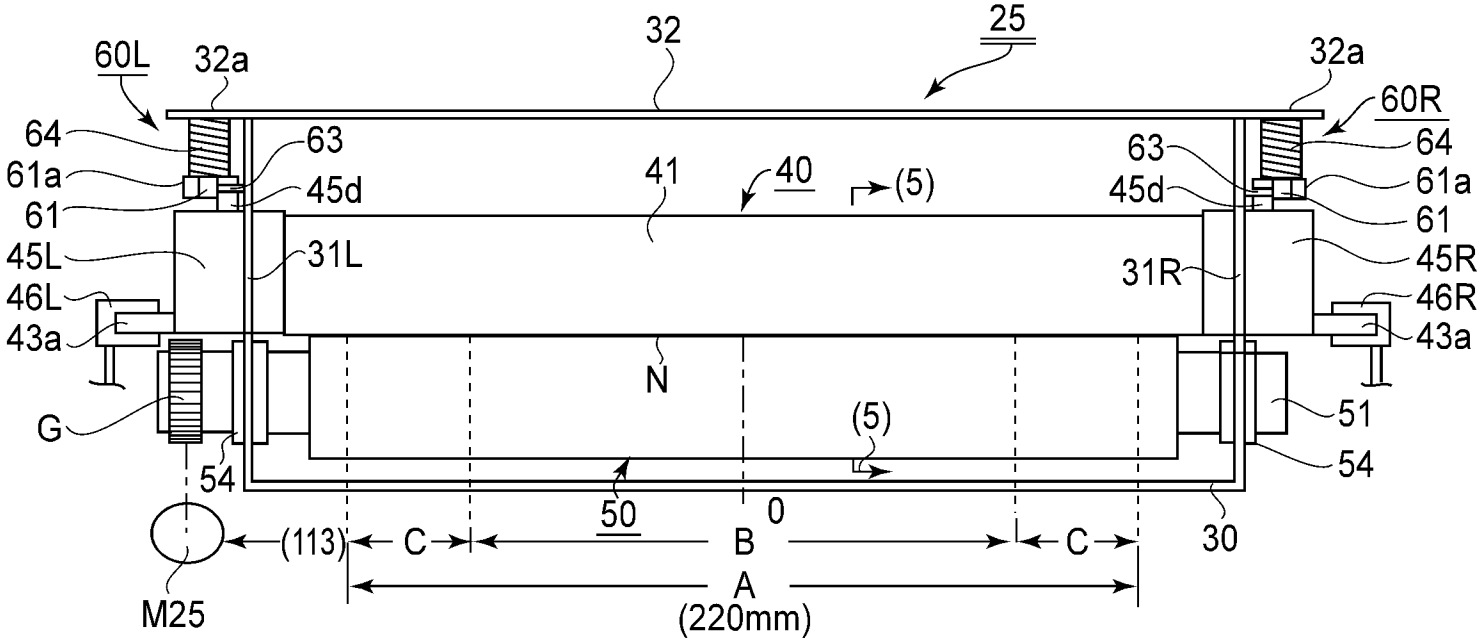
FIG. 3 is a front view of the fixing device in accordance with the present invention.
Figure 4:
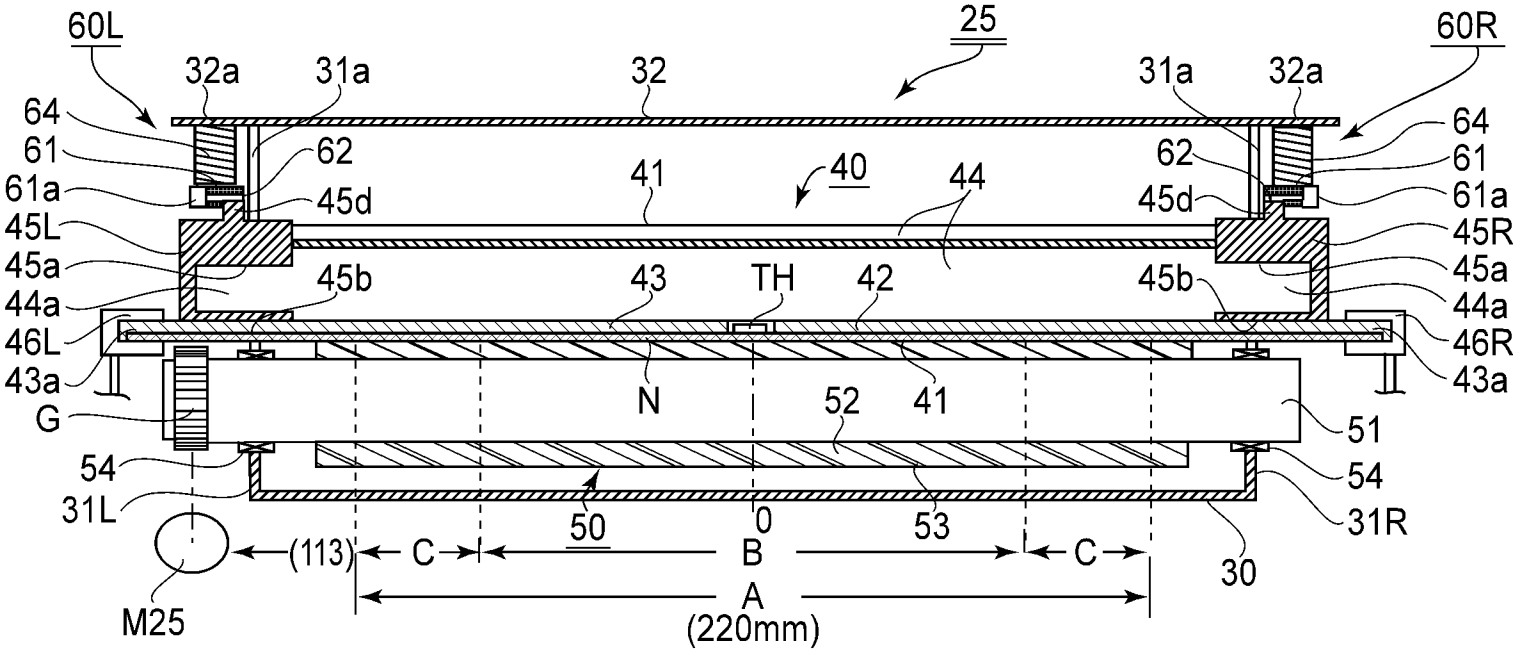
FIG. 4 is a schematic sectional view of the fixing device in accordance with the present invention, at a vertical plane parallel to the lengthwise direction of the device.
Figure 5:
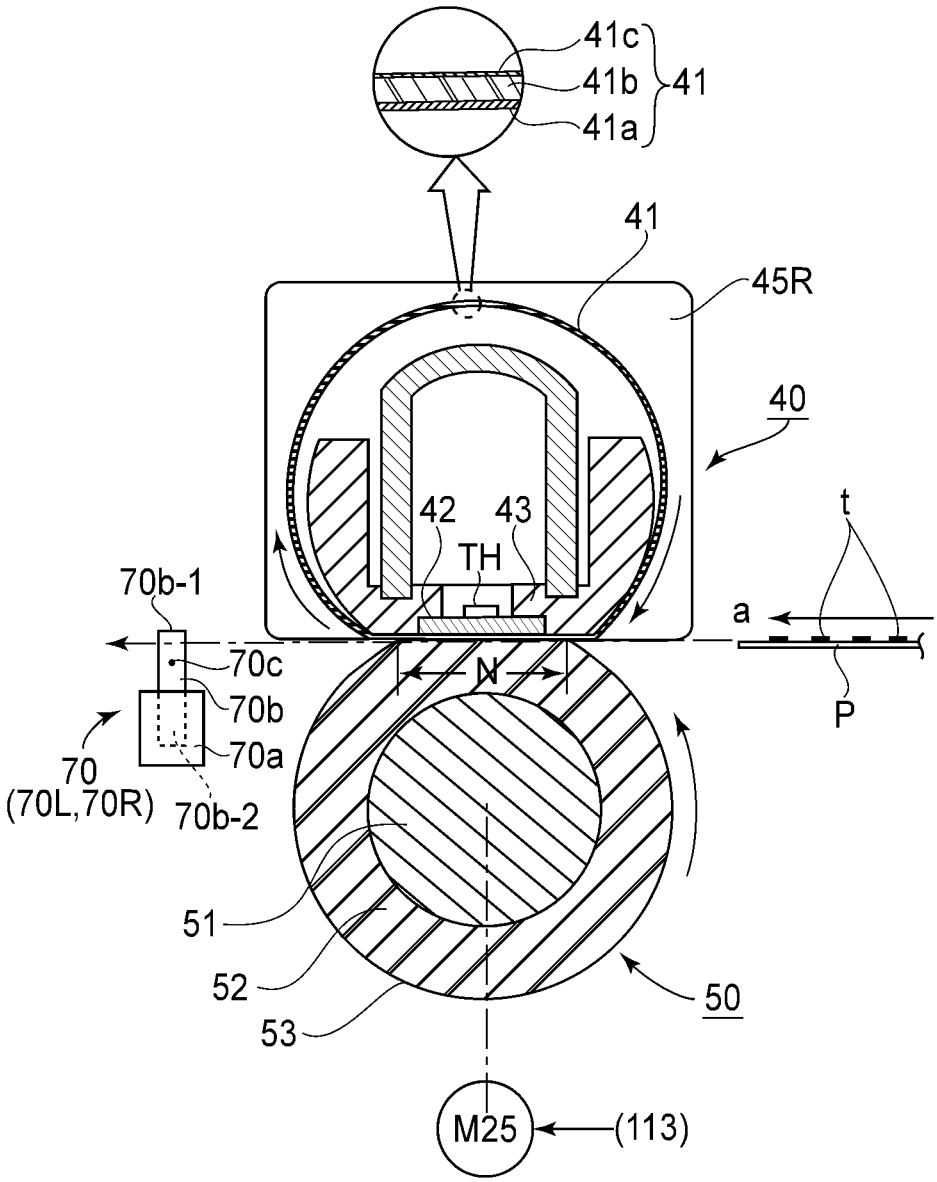
FIG. 5 is a schematic sectional view of the fixing device in accordance with the present invention, at a plane which coincides with a line (5)-(5) in FIG. 3.

The fixing device 25 in this embodiment is an image heating device which has a pressure applying rotational member and a rotational heating member. It is structured so that the pressure applying rotational member is driven, and the rotational heating member is rotated by the rotation of the pressure applying rotational member. FIG. 3 is a front view of the fixing device 25, and FIG. 4 is a schematic sectional view of the fixing device 25, at a vertical plane parallel to the lengthwise direction of the device 25. FIG. 5 is a schematic sectional view of the device 25, at a plane which coincides with a line (5)-(5) in FIG. 3.

Designated by a reference numeral 30 is the main frame (device frame, device chassis) of the fixing device 25. The device 25 has a film unit 40, which is between the left and right walls 31L and 31R, respectively, of the main frame 30. The device 25 has also a pressure roller 50, which is the aforementioned pressure applying rotational member. The pressure roller 50 is on the underside of the unit 40, and is rotatably supported at its lengthwise ends, by the left and right walls 31L and 31R of the main frame 30, with the presence of a pair of bearings between the lengthwise ends of the pressure roller 50 and the left and right walls 31R, one for one. Designated by a reference numeral 32 is a top wall of the device 25.

1) Unit 40

The unit 40 has a film 41 and a film guide 43. The film 41 is the aforementioned rotational heating member. It is flexible, and is cylindrical (endless). The film guide 43 is a member which guides the film 41 from the inward side of the loop which the film 41 forms.

The film guide 43 can be made of heat resistant resin such as liquid polymer, PPS (polyphenylene-sulfide), PEEK (polyether ether ketone). It is in the form of a trough, the cross section of which is roughly semi-cylindrical in terms of the direction perpendicular to its lengthwise direction. The film guide 43 in this embodiment is made of liquid polymer. The unit 40 has a ceramic heater 42 (which hereafter will be referred to simply as heater 42), which is a heating member for heating the film 41. The heater 42 is attached to the underside of the film guide 43 in such a manner that it extends in the lengthwise direction of the guide 43. Thus, the film guide 43 doubles as a heater supporting member. The heater 42 is in contact with the inward surface of the film 41, and heats the film 41.

The pressure roller 50 is kept pressed against a combination of the heater 42 and film guide 43, with the presence of the film 41 between the pressure roller 50 and the combination of the heater 42 and film guide 43, forming thereby the nip N of the fixing device 25. Thus, the combination of the heater 42 and film guide 43 plays also the role of forming the nip N.

The fixing device 25 has also a pressure application stay 44, which is in hollow of the film guide 43 and extends in the left-right direction. The pressure application stay 44 is for catching the pressure, which it receives by way of the left and right flanges 45L and 45R, and transmitting the pressure to the guide 43 uniformly across the lengthwise direction of the guide 43. Thus, a rigid substance such as iron, stainless steel, zinc-coated steel, etc., can be used as the material for the pressure application stay 44. As for the shape of the pressure application stay 44, it is U-shaped in cross section. In order to make the stay 44 more rigid, the stay 44 is positioned so that the open side of the stay 44 faces downward. The material for the pressure application stay 44 in this embodiment is zinc-coated plate. The film guide 43 is held to the pressure application stay 44. The film 41 is loosely fitted around an assembly of the pressure application stay 44, the film guide 43, and the heater 42.

Figure 6:
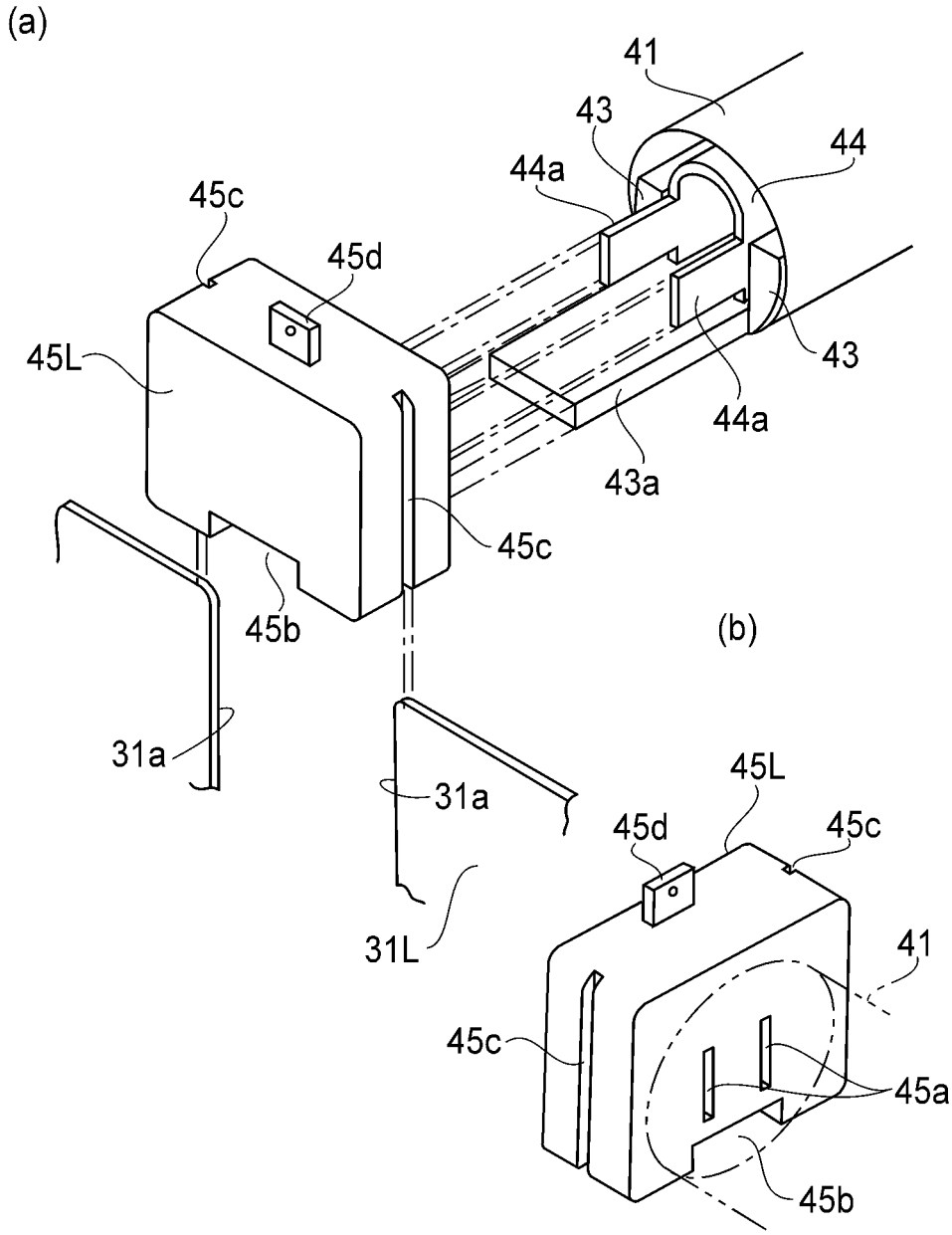
FIG. 6(*a*) is a perspective view of the left flange of the fixing device in accordance with the present invention, and FIG. 6(*b*) is a perspective view of the left flange of the fixing device, as seen from the inward side of the fixing device.

Each of the left and right ends of the pressure application stay 44 has a pair of arms 44*a*, which extend outward of the film 41 through the corresponding (left or right) openings of the film 41, respectively. The left and right pair of arms 44*a* are fitted with the left and right flanges 45L and 45R, which are molded of heat resistant resin, and are shaped so that their shapes are mirror images of each other. FIG. 6(*a*) is a perspective view of the left flange 45L of the fixing device 25, and FIG. 6(*b*) is a perspective view of the left flange 45L as seen from the inward side of the device 25. The right flange 45R is in the form of the reflection of the left flange 45L in a mirror.

The left flange 45L is provided with a pair of holes 45*a*, which are on the inward side of the left flange 45L, and in which the pair of arms 44*a* of the pressure application stay 44 fit, one for one. The right flange 45R is provided with a pair of holes 45*a*, which are on the inward side of the right flange 45R, and in which the pair of arms 44*a* of the pressure application stay 44 fit, one for one. As the arms 44*a* are fully inserted into the holes 45*a*, one for one, the left and right flanges 45L and 45R become solidly attached to the left and right ends of the pressure application stay 44.

With the left and right flanges 45L and 45L being solidly attached to the pressure application stay 44 as described above, the film 41 is between the left and right flanges 45L and 45R. Thus, the left edge of the film 41 is controlled in position by the inward surface of the left flange 45L, whereas the right edge of the film 41 is controlled in position by the inward surface of the right flange 45R.

Further, each of the left and right ends of the film guide 43 has an arm 43*a*, which extends outward of the film 41 through the corresponding (left or right) openings of the film 41, respectively. With the left and right flanges 45L and 45L being attached to the pressure application stay 44 as described above, the left arm 43*a* of the guide 43 extends outward of the flange 45L through the groove 45*b* of the left flange 45L, whereas the right arm 43*a* of the guide 43 extends outward of the right flange 45R through the groove 45*b* of the flange 45R.

The left and right flanges 45L and 45R are provided with a pair of vertical slits 45*c*, which accommodate the flange guiding vertical edges of the left and right walls 31L and 31R of the main frame 30, one for one. With the flange guiding vertical edge portions of the left and right walls 31L and 31R being fitted in the vertical slits 45*c* of the left and right flanges 45L and 45R, respectively, the left and right flanges 45L and 45R can be vertically slid relative to the left and right walls 31L and 31R while being guided by the flange guiding vertical edges of the left and right walls 31L and 31R, respectively. That is, the film unit 40 is held by the left and right walls 31L and 31R in such a manner that they can be vertically slid relative to the left and right walls 31L and 31R, respectively.

The film 41 is a laminar film, having three layers, that is, the substrate layer 41*a*, an elastic layer 41*b*, and a surface layer 41*c*. The substrate layer 41*a* is the innermost layer, and the elastic layer is the middle layer. The surface layer 41*c* is the outermost layer. The film 41 is thin and flexible. If it is left by itself, its remains roughly cylindrical because of its resiliency.

The substrate layer 41*a* is the layer which is responsible for the mechanical properties, such as the flatness of the film 41, and the resistiveness of the film 41 to twist. It can be made of resin such as polyimide, highly heat-conductive pure metal, highly heat-conductive metallic alloy such as stainless steel, and the like. The film 41 needs to be compliant to the surface texture of the recording medium. Thus, the elastic layer 41*b* is made of silicone rubber or the like. Incidentally, in some cases, the film 41 is not provided with the elastic layer 41*b*, in consideration of cost or the like factor. The surface layer 41*c* is for preventing contaminants, such as toner particles and paper dust, from adhering to the film 41. Thus, it is formed of PFA (copolymer of tetrafluoroethylene and perfluoroalkylvinyl-ether), PTFE (polytetrafluoroethylene), which are excellent in parting properties.

The film 41 in this embodiment is 18 mm in diameter, and 230 mm in length. Its substrate layer 41*a* is 55 μm in thickness, and is made of a mixture of polyimide, and carbon used as filler for increasing the polyimide in thermal conductivity. Its elastic layer 41*b* is 150 μm in thickness, and is made of silicone rubber. The surface layer 41*c* of the film 41 is the parting layer. It is formed on the outward surface of the elastic layer 41*b* by coating the outward surface of the elastic layer 41*b* with PFA.

The heater 42 has a long and narrow substrate, a heat generating resistor layer, and a dielectric protective layer. The substrate may be made of dielectric ceramic such as alumina and aluminum nitride, heat resistant resin such as polyimide, PPS and liquid polymer, or the like. The heat generating resistor layer is on the surface of the substrate, which faces the inward surface of the film 41. It is formed of Ag/Pd (silver/palladium) by screen printing or painting. It is linear, or long and narrow, and extends in the lengthwise direction of the substrate. The protective layer is for protecting the heat generating layer, and also, for electrically insulating the heat generating layer. It is formed of a dielectric substance such as glass and polyimide resin, on one of the surfaces of the substrate, in such a manner that it covers the heat generating layer.

In the case of the heater 42 in this embodiment, alumina is used as the material for the substrate, and Ag/Pd is used as the material for the heat generating resistor. Further, the protective layer material is glass. The substrate is 5.83 mm in width, 270 mm in length, and 1 mm in thickness.

Further, the fixing device 25 is provided with a temperature detection element TH, such as a thermistor, which is placed in contact with the opposite surface of the heater substrate from the inward surface of the film 41. In terms of the direction perpendicular to the recording medium conveyance direction, the temperature detection element TH is positioned so that its position roughly coincides with the centerline O of the recording medium conveyance passage. That is, it is positioned so that it will be within the recording medium path regardless of the size (width) of a sheet P of recording medium conveyable through the fixing device 25.

The outward end of one of the arms 43*a* of the guide 43, which extends outward beyond the left flange 45L through the groove 45*b* of the left flange 45L, is in connection to a power supply connector 46L for the heater 42, and the outward end of the other arm 43*a*, which extends outward beyond the right flange 45R through the groove 45*b* of the right flange 45R, is in connection to a temperature control connector 46R.

The heat generating resistor layer of the heater 42 is supplied with electric power from an electric power supply (unshown) through the connector 46L. As it is supplied with electric power, it generates heat, whereby the heat generation range of the heater 42 quickly increases in temperature. The temperature of the heater 42 is detected by the temperature detection element TH, and the information regarding the detected temperature is inputted into the control section 113 through the connector 46R. The control section 113 controls the electric power supply from the electric power supply to the heat generating resistor layer of the heater 42, so that the temperature of the heater 42 is made to rise to a preset level (fixation temperature), and remain at the preset level, in response to the temperature information inputted from the temperature detection element TH.

2) Pressure Roller 50

The pressure roller 50 is made up of a metallic core 51, an elastic layer 52, and a parting layer 53. The metallic core 52 is made of iron, aluminum, or the like. The elastic layer 52 is made of silicone rubber or the like. The parting layer 53 is made of PFA or the like. The hardness of the pressure roller 50 is required to be such that it can form a nip (fixation nip) which is wide enough for fixation, and also, such that it allows the pressure roller to be durable. Thus, it is desired to be in a range of 40-70 degrees in Asker C hardness scale, under a load of 1 kgf.

In this embodiment, the metallic core 51 is made of aluminum, and is 11 mm in diameter. The elastic layer 52 formed on the peripheral surface of the metallic core 51, of silicone rubber or the like, is 3.5 mm in thickness. The parting layer 53, which covers the elastic layer 52, is a piece of electrically conductive PFA tube which is 40 μm in thickness. The pressure roller 50 in this embodiment is 56 degrees in hardness, 18 mm in external diameter, and 226 mm in the length of its elastic layer 52.

The pressure roller 50 is rotatably supported by the left and right walls 31L and 31R of the fixing device 25; the left and right ends of the metallic core 51 are supported by the left and right walls 31L and 31R of the device 25, with the presence of a pair bearings between the left and right ends of the metallic core 51 and the walls 31L and 31R, one for one. There is a drive gear solidly attached to the left end of the metallic core 51. Referring to FIG. 5, the pressure roller 50 is rotated by the fixation motor M25. More specifically, as the fixation motor 25 is rotated forward, the forward driving force of the motor M25 is transmitted to the gear G through a driving force transmitting means (unshown), whereby the pressure roller 50 is rotated at a preset speed in the counterclockwise direction indicated by an arrow mark.

3) Pressure Switching Section 60 (60L and 60R)

Figure 7:
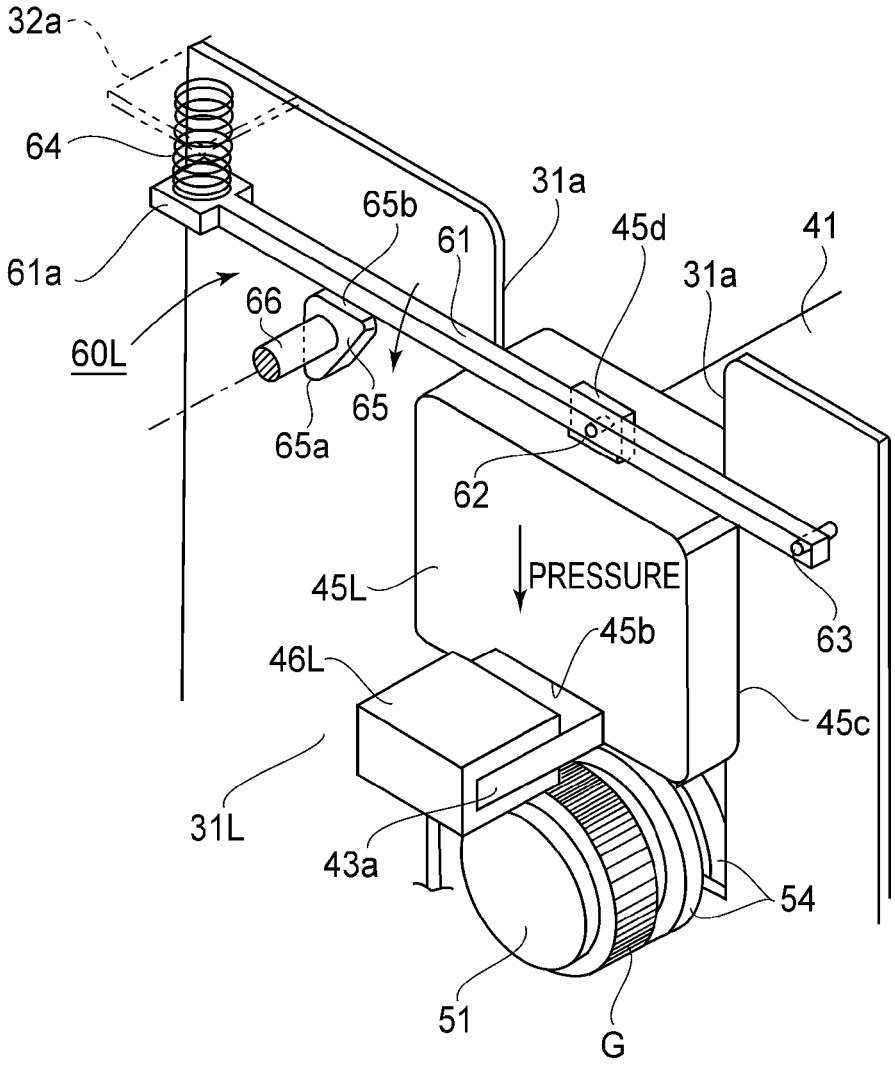
FIG. 7 is a perspective view of the pressure switching section of the fixing device in accordance with the present invention, when pressure is being applied to the nip N of the fixing device.
Figure 8:
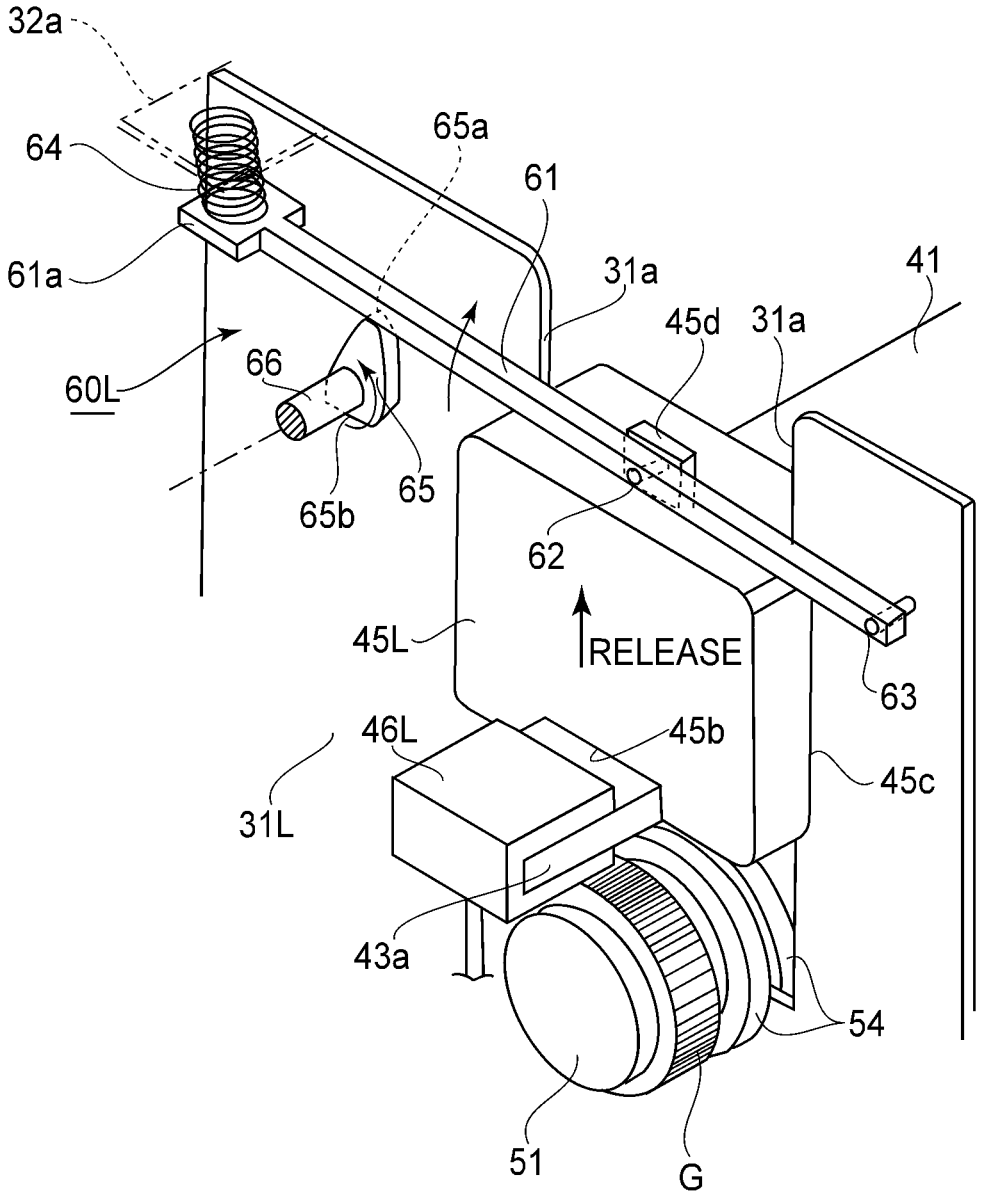
FIG. 8 is a perspective view of the pressure switching section of the fixing device in accordance with the present invention, when no pressure is being applied to the nip N of the fixing device.

The pressure switching section 60 is a mechanism for switching the fixing device 25 in the state of the nip N of the device 25 between the state in which the pressure roller 50 is kept pressed against the combination of the heater 42 and guide 43, and the state in which the pressure roller 50 is not kept pressed against the combination; it is a mechanism for temporarily removing pressure from the nip N of the fixing device 25, and then, reapplies pressure to the nip N after a preset length of time. The fixing device 25 in this embodiment has a pair of pressure switching sections, that is, sections 60L and 60R, which are on the outward sides of the walls 31L and 31R, respectively. The sections 60L and 60R are symmetrically positioned relative to the centerline of the fixing device 25 in terms of the direction perpendicular to the recording medium conveyance direction. FIGS. 7 and 8 are drawings which show the structure of the pressure switching left section 60L. The pressure switching right section 60R is the same in structure as the left section 60L, although it is shaped so that it is symmetrical to the right section 60R with reference to the centerline of the fixing device 25. The left and right sections 60L and 60R are the same in operation and the timing of the operation. FIGS. 7 and 8 show the left section 60L when the pressure is being applied by the section 60L, and when no pressure is being applied by the section 60L, respectively.

Each of the pressure switching sections 60 (60L and 60R) has a lever 61 (pressure applying metallic plate), which is on the top side of the flange 45 (45L or 45R). The lever 61 is in connection to the flange 45. More specifically, each flange 45 is provided with a projection 45*d*, which is at the center of the top surface of the flange 45, and a lever supporting shaft 62 is put through a part of the lever 61 and the projection 45*d*. Thus, the lever 61 is rotationally movable about the shaft 62. One end of the lever 61 is in connection to the side wall 31 (31L or 31R). More specifically, a shaft 63 is put through the end of the lever 61, and is attached to the side wall 31, so that the lever 61 is rotationally movable about the shaft 63.

The other end of the lever 61 is in the form of a spring seat 61*a*, which supports a compression spring 64, which is between the spring seat 61*a* and an extension 32*a* of the top wall of the fixing device 25. There is a cam 65 for rotationally moving the lever 61. In terms of the lengthwise direction of the lever 61, the cam 65 is between the spring seat 61*a* and shaft 62. In terms of the vertical direction, the cam 65 is immediately below the lever 61. As a shaft 66, to which the cam 65 is attached, is rotated, the cam 65 rotates, rotationally moving thereby the lever 61 about the shaft 63. In this embodiment, the shaft 66 is rotated by the aforementioned motor M25. The motor M25, the cam 65, and the shaft 66 make up such a cam driving mechanism (unshown) that as the shaft 66 is rotated once by the reversal (backward) driving of the motor M25, the cam 65 rotates once.

Referring to FIG. 7, the profile of the cam 65 is such that when the cam 65 is in its home position, its portions 65*a* and 65*b*, which are highest and lowest in lift, face downward and upward, respectively. It is when the cam 65 is in its home position that the pressure switching section 60 applies pressure to the nip N of the fixing device 25.

That is, when the cam 65 is in its home position, there is a gap between the lowest lift portion 65*b* of the cam 65 and the bottom surface of the lever 61, and therefore, the cam 65 does not act on the level 61. In this state, the lever 61 is in its lowest position, into which it is moved by being rotationally moved about the shaft 63 by the resiliency of the spring 64.

As the lever 61 is rotationally moved downward by the resiliency of the spring 64, the flange 45 is moved downward by the combination of the shaft 62 and projection 45*d*, while being guided by the its slits 45*c* and the flange guiding edges of the side walls 31 (31L or 31R).

As the flange 45 is moved downward, the pressure application stay 44 is moved downward by the flange 45, whereby the combination of the heater 42 and film guide 43 is pressed against the pressure roller 50, that is, against the resiliency of the elastic layer 52 of the pressure roller 50, with the presence of the film 41 between the combination of heater 42 and film guide 43, and the pressure roller 50. Thus, the nip N, which has a preset width in terms of the recording medium conveyance direction a, is formed between the combination of the heater 42 and film guide 43, which are the nip formation members, and the pressure roller 50 (as pressure applying rotational member), with the presence of the film 41 (rotational heating member) in the nip N.

In this embodiment, the aforementioned preset amount of pressure is 20 kgf, and the dimension of the nip N in terms of the recording medium conveyance direction a is 7 mm.

Referring to FIG. 7, the cam 65 is rotated out of its home position by the reversal driving of the motor M25. As the cam 65 is rotated halfway (180°), the portion of the cam 65 between the lowest lift portion 65*b* of the cam 65 and the highest lift portion 65*a* of the cam 65, comes into contact with the bottom surface of the lever 61, and moves the lever 61 upward, whereby the lever 61 is rotationally moved upward about the shaft 63 against the resiliency of the spring 64.

As the lever 61 is rotationally moved upward by the cam 65, the flange 45 is moved upward by the combination of the shaft 62 and projection 45*d* while being guided by the flange guiding edge of the side walls 31L (31R), which are fitted in the slits 45*c* of the flange 45. Consequently, the combination of the pressure application stay 44, the film guide 43, and the heater 42 is moved upward, reducing thereby the amount of the pressure being applied upon the pressure roller 50 by the spring 64. Then, as the highest lift portion 65*a* of the cam 65 points straight upward as shown in FIG. 8, the lever 61 reaches its highest position, freeing thereby the nip N of the pressure from the spring 64. Further, as the lever 61 is lifted by the cam 65, the combination of the heater 42 and film guide 43 is moved in the direction to separate from the pressure roller 50. Therefore, the combination of the heater 42 and film guide 43 stops pinching the film 41; the film is freed.

As the cam 65 is rotated latter half (180°) of its full rotation, the portion of the cam 65, which is between the highest lift portion 65*a* and lowest life portion 65*b*, moves in the direction to move away from the lever 61. Therefore, the lever 61 is rotated downward about the shaft 63 by the resiliency of the spring 64. Therefore, the flange 45 is moved down by the lever 61, while being guided by its slits 45*c* and the flange guiding edges 31*a* of the side walls 31 (31L or 31R), because the lever 61 is connected to the flange 45 by the shaft 62 and projection 64*d*, and also, the flange guiding edges 31*a* of the side wall 31 is in the slits 45*c* of the flange 45. Thus, the combination of the pressure application stay 44, the film guide 43, and the heater 42 is moved downward, increasing the pressure applied to the pressure roller 50.

Next, referring to FIG. 7, as the cam 65 is rotated further, it returns to its home position, where its highest lift portion 65*a* points downward, and its lowest lift portion 65 does not reach the bottom surface of the lever 61. In other words, the pressure switching section 60 puts the nip N back into the initial condition in terms of the nip pressure; it reapplies pressure to the nip N.

4) Fixing Operation

The fixing device 25 begins to rotate the pressure roller 50 by driving the motor M25 forward, after its nip N is changed in internal pressure back to the preset pressure (fixation pressure), that is, after it is put in the state shown in FIG. 5, by the pressure applying operation carried out by the nip pressure switching section 60.

As the pressure roller 50 is rotated, the film 41 is circularly moved by the rotation of the pressure roller 50. More specifically, the film is circularly moved by the friction generated between the peripheral surface of the pressure roller 50 and the surface of the film 41 in the nip N. In the nip N, the inward surface of the film 41, which is fitted around the combination of the pressure application stay 44, the film guide 43, and the heater 42, slides on a part of the combination of the heater 42 and film guide 43, which functions as a nip forming member, at roughly the same velocity as the peripheral velocity of the pressure roll 50, while remaining in contact with the part of the combination. As the film 41 is rotated by the rotation of the pressure roller 50, it tends to wobble sideways (left or right). In this embodiment, however, the film 41 is prevented from wobbling sideways, by the inward surface of the left flange 45L and the inward surface of the right flange 45R.

The heater 42 is increased in temperature to a preset level by the electric power supplied thereto. Then, it is controlled by controlling the power supply thereto so that its temperature remains at the preset level.

While the fixing device 25 is in the above described condition, a sheet P of the recording medium on which an unfixed toner image 5 is present is introduced into the nip N of the device 25, with the image bearing surface of the sheet P facing the film 41. As the sheet P is introduced into the nip N, it remains in contact with the outward surface of the film 41, and is conveyed through the nip N along with the film 41, while remaining pinched between the pressure roller 50 and film 41. While the sheet P is conveyed through the nip N, the heat of the film 41 is given to the sheet P and the toner image t thereon. Further, the sheet P and the toner image t thereon are subjected to the pressure in the nip N. Thus, the toner image t is fixed to the surface of the sheet P, on which the toner image t is, becoming thereby a solid image. As the sheet P is conveyed out of the nip N, it separates by itself from the surface of the film 41 at the downstream end of the nip N, and then, comes out of the fixing device 25.

Referring to FIGS. 3 and 4, a reference character A denotes the dimension (width) of the widest sheet P of the recording medium conveyable through the fixing device 25. In this embodiment, the width A is 220 mm. A reference character B denotes the dimension (width) of a sheet P of the recording medium, which is narrower than the width A. A reference character O denotes the recording medium conveyance reference line (theoretical line: centerline of the recording medium conveyance passage in terms of a direction perpendicular to recording medium conveyance direction). A reference character C denotes the dimension (width) of the out-of-sheet-path-area of the recording medium conveyance passage, which occurs as a sheet P of the recording medium narrower than the width A is conveyed through the recording medium conveyance passage.

A sheet P of the recording medium is conveyed through the fixing device 25 so that its centerline in terms of the direction perpendicular to its conveyance direction coincides with the centerline of the recording medium conveyance passage of the device 25 in terms of the direction perpendicular to the recording medium conveyance direction. Therefore, if a sheet P of the recording medium, which is narrower than the width A, is conveyed through the fixing device 25, two out-of-sheet-path areas are generated at the left and right sides, one for one, of the recording medium path. Each of the two areas is (A−B)/2 in width in terms of the direction perpendicular to the recording medium conveyance direction. The width of the effective heating range of the heater 42 is set to be the same as, or slightly larger than, the width A.

5) Detection of Off-center Conveyance of Sheet P of Recording Medium, and Control of Fixing Device 25 Based on Detection of Off-Center Conveyance of Sheet P Where a sheet P of the recording medium is conveyed in the recording medium conveyance passage of the image forming apparatus 100 is determined by where and how the sheet P is set in the sheet feeding section 13 of the apparatus 100. If widest sheets P of the recording medium, and sheets P of the recording medium narrower than the widest sheet P, are stacked in mixture in the sheet feeding section 13 of the apparatus 100, it is possible that the narrow sheets P of the recording medium will be conveyed off-center. Further, if narrower sheets P of the recording medium are set in the sheet feeding section 13, with movable side guides (unshown) of the sheet feeding section 13, which are for controlling the position of the left and right edges of a sheet P of the recording medium, being left where they should be for a widest sheet P of the recording medium, it is possible that the narrow sheets P of the recording medium may be conveyed off-center, or centered. Whether they are conveyed off-center or centered is determined by the position in which the narrow sheets P were placed in the sheet feeding section 13. That is, if the narrow sheets P are set in the sheet feeding section 13 so that they are in contact with one of the movable side guides, it is possible that they all will be conveyed off-center. Incidentally, the widest sheets P of the recording medium are not conveyed off-center, because they are controlled by (in contact with) both side guides.

The aforementioned "off-center sheet conveyance" means that when a sheet P of the recording medium is conveyed through the image forming apparatus 100, its centerline in terms of the direction perpendicular to the recording medium conveyance direction does not coincides with the recording medium conveyance reference line, that is, the centerline of the recording medium conveyance passage of the apparatus 100, in terms of the direction perpendicular to the recording medium conveyance direction. Hereinafter, if the centerline of a sheet P of the recording medium, in terms of the direction perpendicular to the recording medium conveyance direction, coincides with the recording medium conveyance reference line, that is, the centerline of the recording medium conveyance passage of the apparatus 100, in terms of the direction perpendicular to the recording medium conveyance direction, the sheet P is said to be being conveyed centered.

Thus, the fixing device 25 is provided with an off-center recording medium conveyance detecting means (recording medium conveyance position detection section) for detecting whether or not a sheet P of the recording medium is being conveyed off-center through the device 25 after being introduced into the device 25. In a case where a sheet P of the recording medium having the width B, which is less than the width A of the widest sheet P of the recording medium conveyable through the device 25, is introduced into the nip N, the off-center recording medium conveyance detecting means can detect whether the sheet P is being conveyed off-center or centered.

In the following description of the present invention, a widest sheet P of the recording medium will be referred to as a normal sheet P1, whereas a sheet P of the recording medium which is narrower than a normal sheet P1 will be referred to as a narrow sheet P2. In order to enable the fixing device 25 in this embodiment to detect the position of a sheet P of the recording medium which is being conveyed through the device 25, the device 25 is provided with a pair of sheet width sensors 70 as the off-center recording medium conveyance detecting means, which are in the recording medium conveyance passage of the device 25. One of the sensors 70 is on one side of the aforementioned centerline of the recoding medium conveyance passage, and the other is on the other side.

Figure 9:
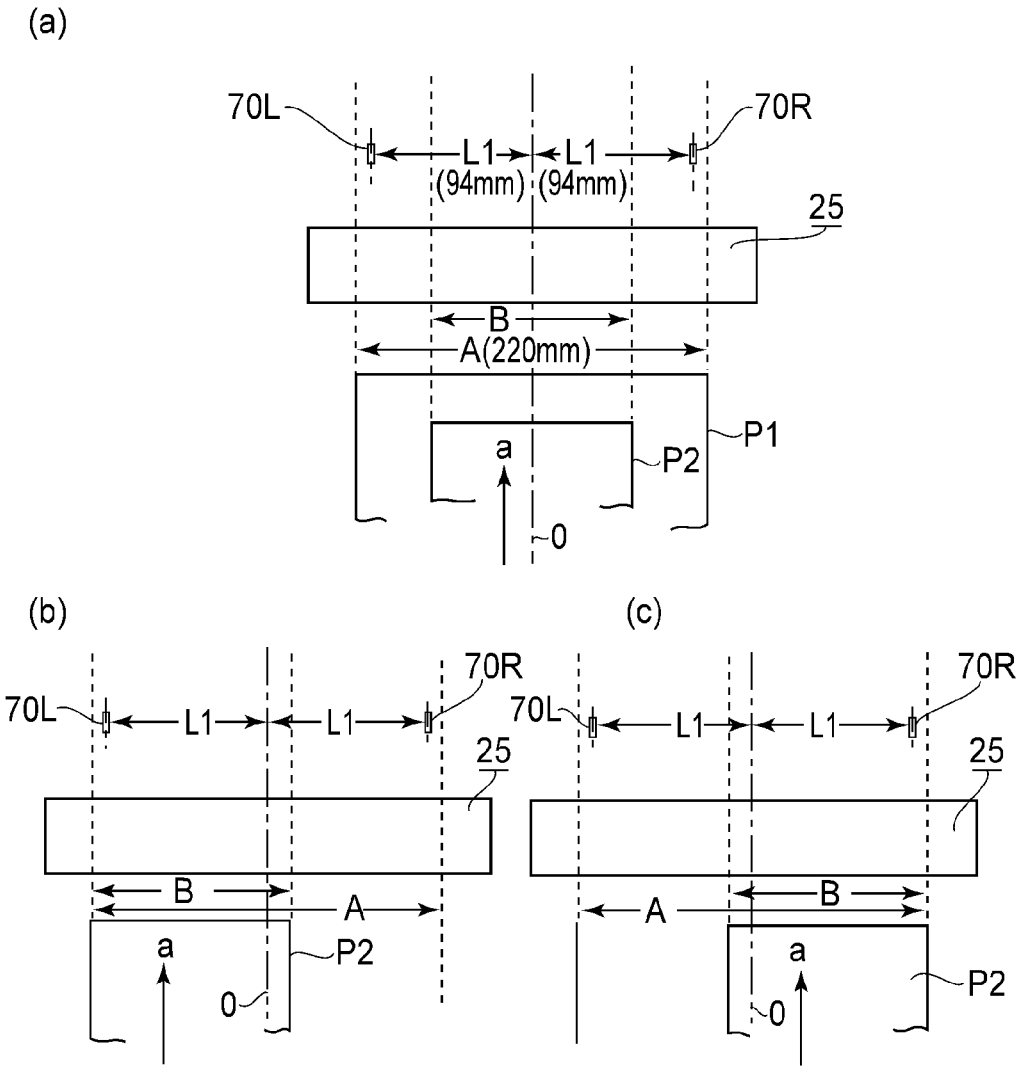
FIG. 9(*a*) is a diagram which shows the positional relationship between a sheet of the recording medium and the recording medium passage of the fixing device in accordance with the present invention, when the sheet is being conveyed centered through the fixing device.

Referring to FIGS. 5, and 9(*a*)-(9*c*), the fixing device 25 in this embodiment is provided with two sheet width sensors 70, that is, a left sheet width sensor 70L and a right sheet width sensor 70R. In terms of the recording medium conveyance direction, the left and right sheet width sensors 70L and 70R are at the downstream end of the recording medium conveyance passage of the device 25 (exit end of device 25). In terms of the direction perpendicular to the recording medium conveyance direction, the left and right sheet width sensors 70L and 70R are positioned 94 mm (L1) away leftward and rightward, respectively, from the recording medium conveyance reference line O. That is, the left and right sheet width sensors 70L and 70R are within the path of the normal sheet P1, and near the left and right edges, respectively, of the path of the normal sheet P1.

Referring to FIG. 5, the sheet width sensor 70 in this embodiment is made up of a photo-coupler 70*a* and a sensor lever 70*b*. The lever 70*b* is rotationally movable about a lever supporting shaft 70*c*. When the lever 70*b* is free from a sheet P of the recording medium P, an end portion 70*b*-1, that is, one of the lengthwise end portion of the lever 70*b*, is in the recording medium conveyance passage of the fixing device 25, and an end portion 70*b*-2, or the other lengthwise end of the lever 70*b*, is in the light path of the photo-coupler 70*a*, blocking thereby the light path, and therefore, the photo-coupler 61 is kept turned off. That is, when the lever 70*b* is free from a sheet P of the recording medium, it keeps the sheet width sensor 70 turned off.

Then, as a sheet P of the recording medium, which is being conveyed through the recording medium passage of the fixing device 25, comes into contact with the lever 70*b*, the lever 70*b* is pushed by the sheet P, being thereby rotationally moved about the shaft 70*c*. As a result, the end portion 70*b*-2 of the lever 70*b* is moved in the direction to be moved out of the light path of the photo-coupler 70*a*. Therefore, the end portion 70*b*-2 stops blocking the light path. Thus, the photo-coupler 61 is turned on. That is, the sheet width sensor 70 is turned on. The sheet width sensor 70 is kept turned on until the trailing edge of the sheet P moves past the lever 70*b*. As soon as the trailing edge of the sheet P moves past the lever 70*b*, the lever 70*b* rotationally moves back into the position in which it blocks the light path of the photo-coupler 61, whereby the sheet width sensor 70 is turned off.

The ON and OFF signals from the sheet width sensors 70L and 70R are inputted into the controller 101, which determines the position of the sheet P of the recording medium in the fixing device 25, based on the combinations (given in Table 1) of ON and Off signals from the sheet width sensors 70L and 70R.

TABLE 1

| Sensor 70L | Sensor 70R | Sheet Position | Sheet Width |
|---|---|---|---|
| ON | ON | Center | Normal |
| OFF | OFF | Center | Narrow |
| ON | OFF | Left | Narrow |
| OFF | ON | Right | Narrow |

More specifically, as a preset length of time, that is, the length of time it takes for a sheet P of the recording medium to reach the sheet width sensors 70L and 70R from when the sheet P begins to be fed from the sheet feeding section 13 into the main assembly of the image forming apparatus 100, elapses, the controller 101 checks the state of the input signals from the sheet width sensors 70L and 70R. If both the input signals from the left and right sheet width sensor 70L and 70R are ON, the controller 101 determines that the sheet P in the fixing device 25 is a normal sheet P1, and the centerline of the sheet P1 is in alignment with the central conveyance reference line (sheet P1 is not off-center) (normal sheet P1 in FIG. 9(*a*)).

If both the input signals from the left and right sheet width sensor 70L and 70R are off, the controller 101 determines that the sheet P in the fixing device 25 is a narrow sheet P2, and the centerline of the sheet P2 is in alignment with the central conveyance reference line (sheet P2 is not off-center) (narrow sheet P2 in FIG. 9(*a*)).

If the left sheet width sensor 70L is on, and the right sheet width sensor 70R is off, the controller 101 determines that the sheet P in the fixing device 25 is a narrow sheet P2, and the sheet P2 is being conveyed off-center leftward as shown in FIG. 9(*b*). Incidentally, An expression "off-center leftward" means that the sheet P2 is being conveyed while remaining deviated leftward from the central conveyance reference line, that is, the centerline of the recording medium passage of the device 25.

If the left sheet width sensor 70R is off, and the right sheet width sensor 70R is on, the controller 101 determines that the recording medium in the fixing device 25 is a narrow sheet P2, and is being conveyed off-center rightward as shown in FIG. 9(*c*). An expression "off-center rightward" means that the recording medium in the device 25 is being conveyed while remaining deviated rightward from the central conveyance reference line, that is, the centerline of the recording medium passage of the device 25.

In this embodiment, the means 70 (recording medium conveyance position detection section) for detecting whether or not a sheet P of the recording medium is being off-center in the fixing device is made up of the sheet width sensor 70L and 70R positioned in the left and right sides, respectively, of the centerline of the recording medium conveyance passage of the fixing device 25. If it is only one of the sheet width sensors 70L and 70R that detects the presence of a sheet P of the recording medium, the controller 101 determines that the sheet P is being off-center.

Figure 10:
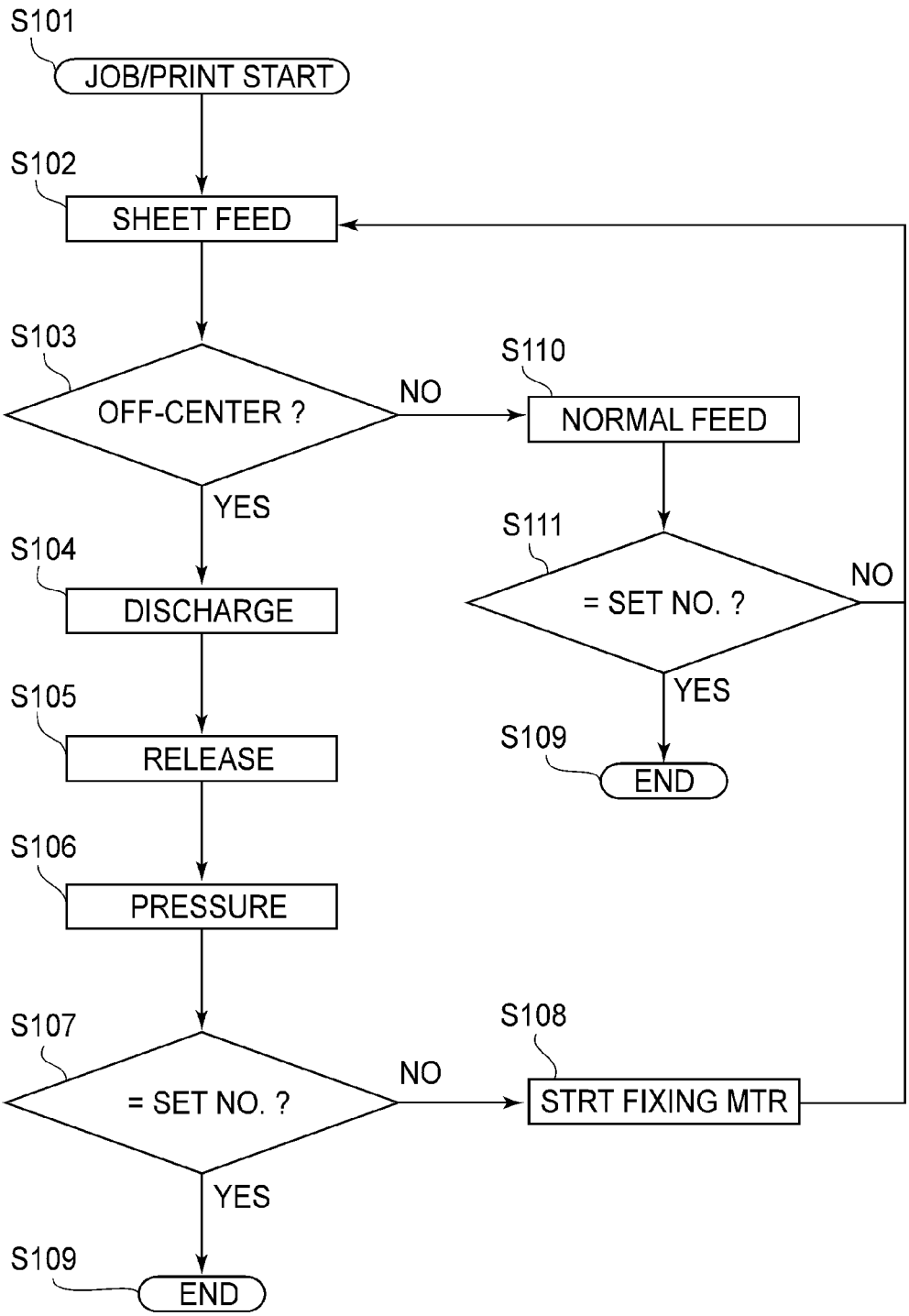
FIG. 10 is a block diagram of the image formation sequence of the image forming apparatus in the first embodiment of the present invention.

Next, referring to the flowchart in FIG. 10, the sheet conveyance control sequence is described. In S101, the controller 101 makes the image forming apparatus 100 start a printing job (for outputting single or multiple prints). In step S102, the controller starts feeding sheets P of the recording medium into the main assembly of the apparatus 100 from the sheet feeding section 13. In step S103, it determines, based on the detection results from the sheet width sensor 70, whether the sheet P of the recording medium in the fixing device 25 is being conveyed off-center or centered.

If the controller 101 determines in step S103, that the sheet P is being conveyed centered, it keeps the fixing device 25 in the normal condition in step S110 (it does not remove pressure from nip N of device 25). In step S111, the controller 101 determines whether or not a preset number of sheets P of the recording medium have been conveyed through the fixing device 25. If it determines that the preset number of sheets P has not been conveyed, it proceeds to S102. If it determines that the preset number of sheets P has been conveyed, it ends the job in step S109.

When it is detected in step S103 that the sheet P is being conveyed off-center, the controller 101 makes the fixing device 25 continue to convey the sheet P, and discharge the sheet P into the delivery tray 28, in S104. As soon as the trailing edge of the sheet P is detected by the sheet discharge sensor 29 of the fixing device 25, the controller 101 stops forward driving of the motor M25, in S105, and then, it starts reversely driving the motor M25. As the motor M25 is reversely driven, the cam 65 of the nip pressure switching section 60 is rotated one full turn, whereby pressure is temporarily removed from the nip N (S105), and then, is reapplied to the nip N after a preset length of time (S106).

More specifically, if the sheet width sensor 70 detects that the sheet P in the fixing device 25 is being conveyed off-center, the controller 101 controls the nip pressure switching section 60 so that pressure is temporarily removed from the nip N of the fixing device 25. As pressure is removed from the nip N in S105, the combination of the heater 42 and film guide 43 separates from the pressure roller 50, stopping thereby pinching the film 41. Thus, the film 41 is instantly untwisted by the resiliency of the film itself.

Then, as the nip pressure switching section 60 reapplies pressure to the nip N as described above, the untwisted film 41 is pinched between the combination of the heater 42, and the film guide 43, and the pressure roller 50, thereby readying the the fixing device 25 for the next printing operation.

If it is determined in S107 that the number of the sheets P conveyed through the fixing device 25 has not reached the preset value, the motor M25 is driven forward in S108 to prevent the out-of-sheet-path areas of the recording medium conveyance passage of the device 25 from excessively increasing in temperature, and also, to prepare for the next sheet conveyance. Then, the controller 101 goes back to S102 to restart feeding another sheet P of the recording medium. This process is repeated until the number of the sheets P the conveyed through the fixing device 25 reaches the preset value. As soon as the preset value is reached, the controller 101 ends the job in S109.

Figure 11:
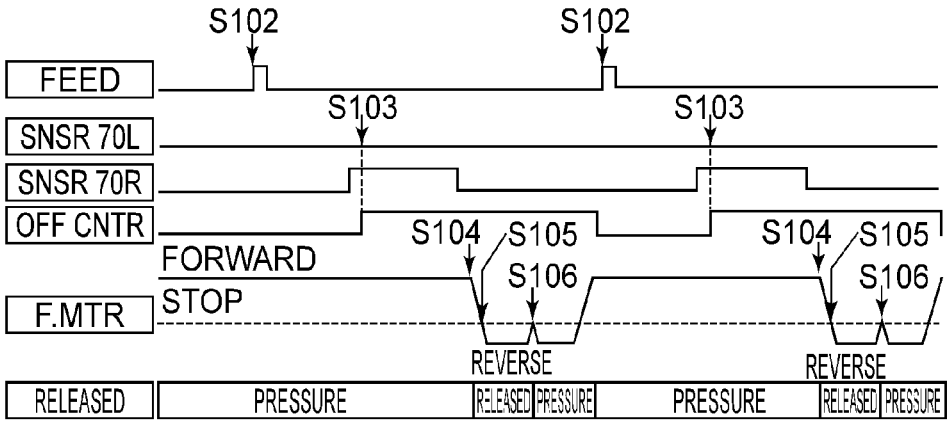
FIG. 11 is a pressure switching timing chart of the fixing device of the image forming apparatus in the first embodiment.

FIG. 11 is a timing chart for the fixing device operation carried out when it is detected that two sheets P of the recording medium are consecutively conveyed off-center rightward relative to the central sheet conveyance reference line (FIG. 9(*c*)). As it is detected by the sheet width sensor 70R in S105 that the sheet P of the recording medium fed in S102 is being conveyed off-center, the controller 101 puts the fixing device 25 in the off-center sheet conveyance mode. In order to prevent the sheet width sensor 70 from making a detection error, 0.1 second is provided between when the sheet width sensor 70 is turned on by the leading edge of a sheet P of the recording medium and when it is determined whether or not the sheet P is being conveyed off-center. As soon as the sheet P is discharged in S104, the controller 101 removes pressure from the nip N in S105, and then, reapplies pressure to the nip N after a preset length of time, in S106.

(3) Characteristic Features of First Embodiment

The image forming apparatus 100 in this embodiment uses the sheet width sensors 70 (70L and 70R) to detect whether or not a sheet P of the recording medium is being conveyed off-center. If it detects that the sheet P is off-center, it extends the sheet interval (length of time between sheet P and immediately following sheet P), and carries out the process of removing pressure from the nip N of the fixing device 25 and reapplying pressure to the nip N, during the extended sheet interval.

The image forming apparatus 100 in this embodiment, and its fixing device 25, the specifications of which are as described above, were tested under the normal condition (23° C. in temperature and 50% in humidity). As a narrow sheet P2, an envelope (142 mm in width and 332 mm in length) was used. The two side guides (unshown) of the sheet feeding means 14, which are for regulating in position the left and right edges of a sheet P of the recording medium, were set so that their distance becomes maximum (220 mm). The sheets P2 were fed so that they would come into contact with the left or right guide. The recording medium conveyance speed was 80 mm/sec, and the target temperature for the temperature control of the fixing device 25 was 200° C.

Figure 12:
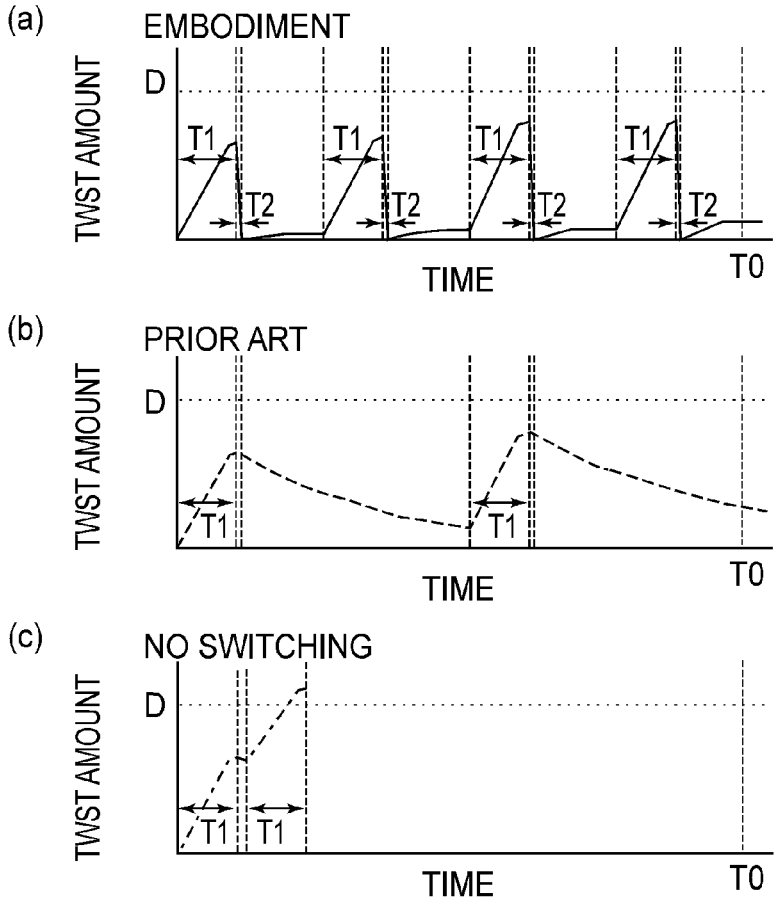
FIGS. 12(*a*)-12(*c*) are diagrams showing the relationship between the length of time it takes for a sheet of the recording medium to be conveyed through the fixing device in the first embodiment and the amount by which the heating film of the fixing device is twisted.

FIGS. 12(*a*)-12(*c*) show the relationships between the length of time sheets P were conveyed through the fixing device 25, and the amount of the twisting of the film 41, for the image forming apparatus (fixing device) (FIG. 12(*a*)), and conventional image forming apparatus (FIG. 12(*b*)). FIG. 12(*c*) shows the relationship in the case where the nip N of the fixing device was not switched in pressure.

In this embodiment, as the "off-center sheet conveyance" is detected, pressure was temporarily removed from the nip N of the fixing device 25 after at least one of the sheets P which were being conveyed off-center was conveyed through the nip N. Then, pressure was put back onto the nip N, and the feeding of sheets P was restarted.

In the case of the conventional image forming apparatus 100 (conventional fixing device 25), as the "off-center sheet conveyance" was detected, the sheet interval was changed so that it became longer after the detection than before the detection, and then, the feeding of sheets P was continued.

In the case where no control was executed when the "off-center sheet conveyance" was detected, the feeding of sheets P was continued without doing anything (without switching nip pressure), even if the "off-center sheet conveyance" was detected.

As a sheet P2 of the recording medium was conveyed through the nip N (sheet P of the recording medium was conveyed off-center through nip N), the film 41 is increased in the amount of its twist.

In the case of the fixing device 25 in this embodiment, a sheet P2 of the recording medium was conveyed off-center in Period T1, and therefore, the film 41 was increased in the amount of its twist. However, pressure is temporarily removed from the nip N, and then, is reapplied to the nip N after a preset length of time, in a period T2. Therefore, the film 41 reduced in the amount of its twist. However, as the feeding of sheets P was restarted after the untwisting of the film 41, the film 41 was twisted again. Thus, pressure was removed again from the nip N. In other words, the feeding of sheets P can be continued while repeating the above described process as shown in FIG. 12(*a*).

Referring to FIG. 12(*c*), in the case where no control is executed, the film 41 increased in the cumulative amount of its twist each time a sheet P of the recording medium was conveyed through the nip N. Therefore, it was possible that as the second sheet P was conveyed, the cumulative amount by which the film 41 was twisted will have exceeded an amount D, beyond which the film 41 becomes damaged. In the case of the film 41 employed by the fixing device 25 in this embodiment, the amount D was roughly 1.1 mm in terms of the film displacement in its lengthwise direction.

In comparison, in the case of the conventional fixing device, as the "off-center sheet conveyance" was detected, the sheet interval was increased, as shown in FIG. 12(*b*), in order to prevent the film 41 from being damaged by the twisting of the film 41. As the sheet interval was increased, the temperature difference between the portion of the pressure roller 50, which was outside the recording medium path, and the portion of the pressure roller 50, which was in the recording medium path, decreased, which in turn, reduced the amount of twisting by the film 41. Thus, the amount of twisting of the film 41 is reduced. However, this method of increasing the sheet interval created a problem in that increasing the sheet interval by an amount large enough for the film 41 to satisfactorily reduce its twist, substantially reduced the image forming apparatus 100 in productivity.

The amount of reduced productivity of the image forming apparatus 100 (fixing device 25) in this embodiment in order to prevent the film 41 from being damaged by being twisted is not as large as the amount of reduced productivity of the conventional fixing apparatus (conventional fixing device), for the following reason. That is, in this embodiment, as the "off-center sheet conveyance" is detected, pressure temporarily is removed from the nip N of the fixing device 25, thereby allowing the film 41 to instantaneously untwisting itself. Referring to FIGS. 12(*a*)-12(*c*), in the case of the conventional image forming apparatus (conventional fixing device), it was possible to convey two sheets of the recording medium between the point in time at which the sheet feeding was started and a point T0 in time, which is one minute from the starting of the sheet feeding. In the case of the image forming apparatus 100 (fixing device 25) in this embodiment, it was possible to convey four sheets of the recording medium.

Shown in Table 2 are the relationship between the length of time it took for 10 sheets of the recording medium to be continuously conveyed, and the presence or absence of the damage to the film 41.

TABLE 2

| | Time for Feeding 10 sheets (sec) | Throughput | Film damage |
|---|---|---|---|
| No control | — | 8 ppm | Yes |
| Prior art | Approx. 290 | 2 ppm | No |
| Embodiment | Approx. 150 | 4 ppm | No |

The length of time it took to convey 10 sheets of the recording medium without damaging the film 41 was roughly 290 seconds for the conventional image forming apparatus (conventional fixing device) seconds. In comparison, it was roughly 150 seconds for the image forming apparatus 100 (fixing device 25) in this embodiment. It is evident from Table 2 that carrying out the control in this embodiment can make an image forming apparatus (fixing device) twice in productivity compared to the conventional control. Incidentally, when no control was carried out, the film 41 was damaged before the tenth sheet of the recording medium was conveyed.

As described above, in this embodiment, as the "off-center sheet conveyance" is detected, pressure is temporarily removed from the nip N, and then, is reapplied to the nip N after a preset length of time. Therefore, the film 41 is allowed to untwist itself without reducing the image forming apparatus (fixing device) in productivity. That is, the present invention has such an effect that the film 41 is allowed to untwist itself, thereby preventing the film 41 from being damaged, without significantly reducing the productivity of the image forming apparatus 100; the on-going printing operation can be continued without significantly reducing the productivity of the image forming apparatus in order to prevent the film 41 from being damaged by being twisted.

It should be noted here that in a case where a narrow sheet P2 is conveyed, even if it is centered (central sheet conveyance), the portions of the pressure roller 50, which are outside the path of the narrow sheet P2 increase in temperature. Thus, they increase in external diameter, which in turn generates such a force that works in the direction to twist the film 41. This force, however, is rather small in this case. Therefore, it is unnecessary to temporarily remove pressure from the nip N, for the following reason. That is, when a narrow sheet P is conveyed centered (central sheet conveyance), the out-of-sheet-path area is divided into two sections, one on each side of the sheet path. Therefore, the temperature difference between the portion of the pressure roller 50, which is within the recording medium path, and the portion of the pressure roller 50, which is outside the recording medium path, does not become as high as that when a narrow sheet P2 is conveyed off-center.

[Embodiment 2]

Figure 13:
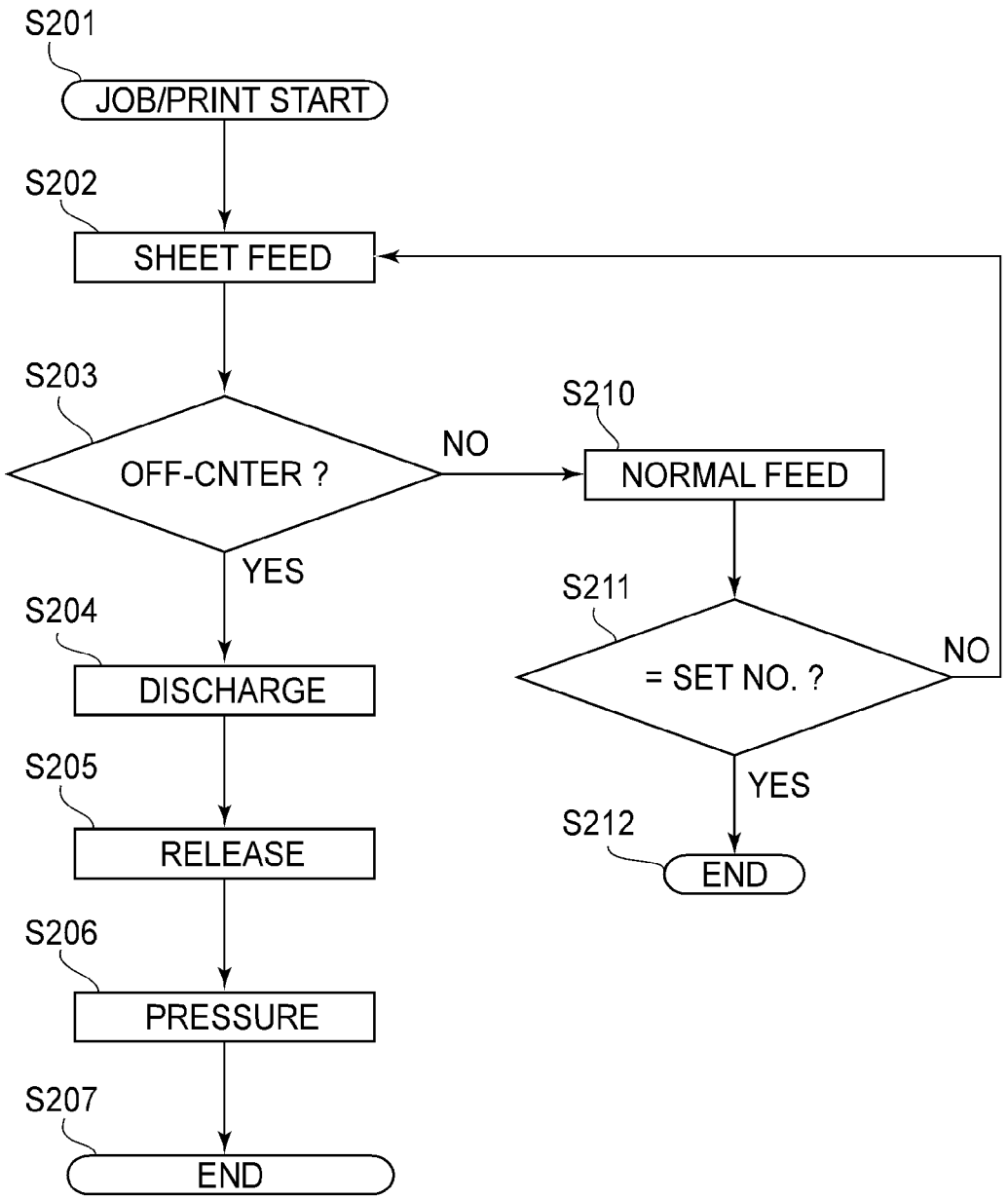
FIG. 13 is a block diagram of the control sequence for the fixing device in the second embodiment of the present invention.

The image forming apparatus 100 and fixing device 25 in this embodiment are the same in structure as those in the first embodiment. Therefore, they are not going to be described here. Next, referring to FIG. 13, their operation sequences, which are carried out after the detection of the "off-center sheet conveyance", are described.

This embodiment is different from the first embodiment in that if the "off-center sheet conveyance" is detected, it is determined that a printing error has occurred. More specifically, when a sheet P of the recording medium is being conveyed off-center, the sheet P is misaligned with an image to be formed thereon. Therefore, it is possible that the resultant image will be practically unusable.

In this embodiment, therefore, as the "off-center sheet conveyance" is detected, pressure is temporarily removed from the nip N, and then, pressure is applied again after a preset length of time. Then, the controller 101 determines that a printing error has occurred. Then, it stops feeding sheets P, preventing thereby a user from wasting sheets P of the recording medium. For the sake of convenience, the image forming apparatus 100 and fixing device 25 may be structured so that a user can choose between the operational sequence in the first embodiment and the one in the second embodiment. The operational sequence for such image forming apparatus and fixing device is as follows:

The controller 101 starts a printing job in S201. It begins, in S202, the feeding of a sheet P of the recording medium. It detects in S203 whether the sheet P in the apparatus 100 is being conveyed off-center or centered, with use of the sheet width sensor 70 (70L and 70R). If it determines that the sheet P is being conveyed centered, it proceeds to S210, in which it continues to feed sheets P. If it determines in S211 that a preset number of sheets P have not been fed, it moves back to S202. If it determines in S211 that the preset number of sheets P have been fed, it proceeds to S212, in which it ends the job of feeding the apparatus 100 with sheets P.

If the controller 101 determines in S203 that the sheet P in the fixing device 25 is being conveyed off-center, it determines that a printing error has occurred, and discharges the sheet P in S204. Then, it temporarily removes pressure from the nip N to allow the film 41 to untwist itself, in S205. Then, it reapplies pressure to the nip N, in S206, to prepare the fixing device 25 for the next job. Then, it proceeds to S207, in which it ends the on-going printing job. That is, after the controller 101 removes pressure from the nip N of the fixing device 25, it stops the feeding of sheets P into the apparatus 100. Regarding the discharging of the sheet P in S204, all that is necessary is that the trailing edge of the sheet P is beyond the nip N of the fixing device 25 in terms of the recording medium conveyance direction.

As described above, in the case of the image forming apparatus in this embodiment, it is detected by the sheet width sensor 70 (70L and 70R) whether or not a sheet P of the recording medium in the fixing device is being conveyed off-center. If the sheet P is being off-center, it is determined that a printing error has occurred. Then, the sheet P is discharged, and pressure is temporarily removed from the nip N of the fixing device. Then, pressure is reapplied to the nip N after a preset length of time. Then, the on-going job is ended as an erroneous job.

The recovery operation carried out by the image forming apparatus in this embodiment after ending the erroneous printing job is similar to the recovery operation to be carried out after the detection of a paper jam or the like. That is, the on-going image forming operation is stopped, and a message for informing a user of the interruption of the on-going image forming operation is displayed. The interrupted operation can be restarted by the resetting of the apparatus by a user, or the recovery operation started by the user.

The image forming apparatus 100 and fixing device 25 in this embodiment were subjected to the same test as the test to which the image forming apparatus 100 and fixing device 25 in the first embodiment were subjected. In the case of this embodiment, as the film 41 was twisted by the "off-center sheet conveyance", it was allowed to untwist itself in six seconds by temporarily removing pressure from the nip N of the fixing device 25 and reapplying pressure to the nip after a preset length of time. Therefore, as soon as a user is informed of a printing error ("off-center sheet conveyance"), the user can quickly reset the apparatus to restore the apparatus in terms of sheet conveyance. Thus, even if "off-center sheet conveyance" occurs, the next job can be quickly started without damaging the film 41.

There are other methods for making the pressure roller 50 uniform in temperature in terms of its lengthwise direction to untwist the film 41. One of these methods is to idle the pressure roller 50. However, this method requires the pressure roller 50 to be idled no less than 15 seconds, being therefore not as efficient as the method used in this embodiment.

As described above, in this embodiment, as the "off-center sheet conveyance" is detected, pressure is temporarily removed from the nip N of the fixing device 25, and then, is reapplied to the nip N after a preset length of time, to allow the film 41 to untwist itself. Then, the on-going printing job is stopped. Therefore, it is possible to more quickly start the next job than in the first embodiment.

[Embodiment 3]

The image forming apparatus 100 and fixing device 25 in this embodiment are different from those in the first embodiment in that the substrate layer 41*a* of the film 41 of the fixing device 25 in this embodiment is made to be 70 μm in thickness, being thicker than that in the first embodiment, which is 55 μm in thickness. In other words, the film 41 in this embodiment is stronger than that in the first embodiment. Otherwise, the structural features of the image forming apparatus 100 and fixing device 25 in this embodiment are the same as those of the image forming apparatus 100 and fixing device 25 in the first embodiment, and therefore, are not going to be described here.

In this embodiment, as soon as the controller 101 detects that two (or more) sheets P of the recording medium were consecutively conveyed off-center, it begins to count the sheets P of the recording medium as they are conveyed through the fixing device 25. Then, as the counts exceeds a preset value, the controller 101 controls the nip pressure switching section 60 so that pressure is temporarily removed from the nip N of the fixing device 25, and then, is reapplied after a preset length of time.

Figure 14:
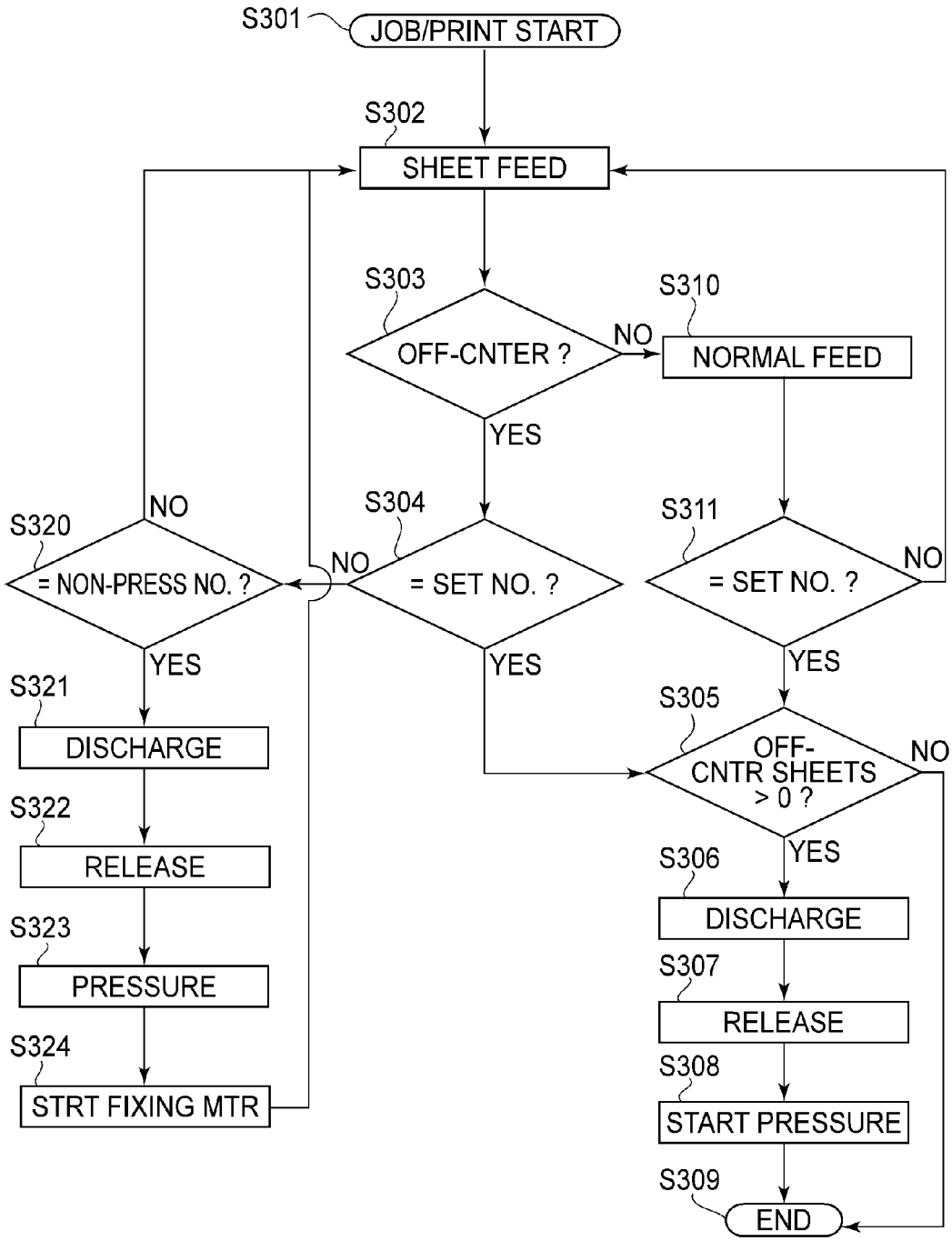
FIG. 14 is a block diagram of the control sequence for the image forming apparatus (fixing device) in the third embodiment of the present invention.

Next, referring to FIG. 14, the sheet feeding sequence in this embodiment is described. In the first and second embodiments, each time a sheet P of the recording medium is conveyed off-center, pressure was temporarily removed from the nip N of the fixing device 25. In this embodiment, however, as soon as it is detected that a sheet P of the recording medium is being conveyed off-center, the controller begins to count the sheets P of the recording medium which were conveyed off-center. Then, as the count of the off-center sheets P of the recording medium exceeds a preset value (pressure removal threshold value), the controller 101 temporarily remove pressure from the nip N, and reapplies pressure to the nip N after a preset length of time. The abovementioned preset value for the pressure removal is to be set based on the strength of the film against twisting. In this embodiment, it was set to three. The control sequence is as follows.

The controller 101 starts a printing job in S301. Then, it begins feeding sheets P of recording medium into the main assembly of the image forming apparatus 100, in S302. Then, it determines in S303 whether the sheet P in the fixing device 25 is being conveyed off-center or centered, based on the results of the sheet detection by the sheet width sensor 70 (70L and 70R). If the controller 101 determines that the sheet P is being conveyed centered, it goes back to S302, and continues to feed sheets P into the main assembly of the apparatus 100. If the controller 101 determines in S311 that a preset number of sheets P have not been conveyed, it goes back to S302. If it determines in S311 that the preset number of sheets P have been conveyed, it proceeds to S305.

If the controller 101 determines in S303 that the sheet P in the fixing device 25 is being conveyed off-center, it determines in S304 whether or not the preset number of sheets P have been conveyed. If the preset number of sheets P have not been conveyed, it determines in S320 whether or not the off-center sheet conveyance count has reached the pressure removal threshold value. If the off-center sheet conveyance count has not reached the pressure removal threshold value, the controller 101 goes back to S302. If the off-center sheet conveyance count has reached the pressure removal threshold value, the controller 101 resets the off-center sheet conveyance counter to zero, and discharges the sheet P in S321-324. Then, it temporarily removes pressure from the nip N, and reapplies pressure to the nip N after a preset length of time. Then, it restarts the fixation motor M25, and goes back to S302.

If the controller 101 determines in S304 or S311, the preset number of sheets P have been conveyed, it proceeds to S305, in which it determines whether or not the off-center sheet conveyance count is no less than zero. If it is no less than zero, the controller 101 discharges the sheet P in S306, temporarily removes pressure from the nip N in S307, and reapplies pressure to the nip N after a preset length of time, in S308. Then, it ends the job in S309. If the off-center sheet conveyance count is zero, the controller 101 ends the job in S309. Regarding the discharging of the sheet P in S306-S308, all that is necessary is for the trailing edge of the sheet P is beyond the nip N of the fixing device 25 in terms of the recording medium conveyance direction.

In the case of the image forming apparatus 100 in this embodiment, it is detected by the sheet width sensor 70 (70L and 70R) whether or not the sheet P in the fixing device 25 is being conveyed off-center. As the number of sheets P conveyed off-center among the sheets P conveyed after the detection of the off-center sheet conveyance reaches the pressure removal threshold value, the sheet interval is widened. Then, pressure is temporarily removed from the nip N of the fixing device, and then, pressure is reapplied to the nip N after a preset length of time, during the extended sheet interval.

Figure 15:
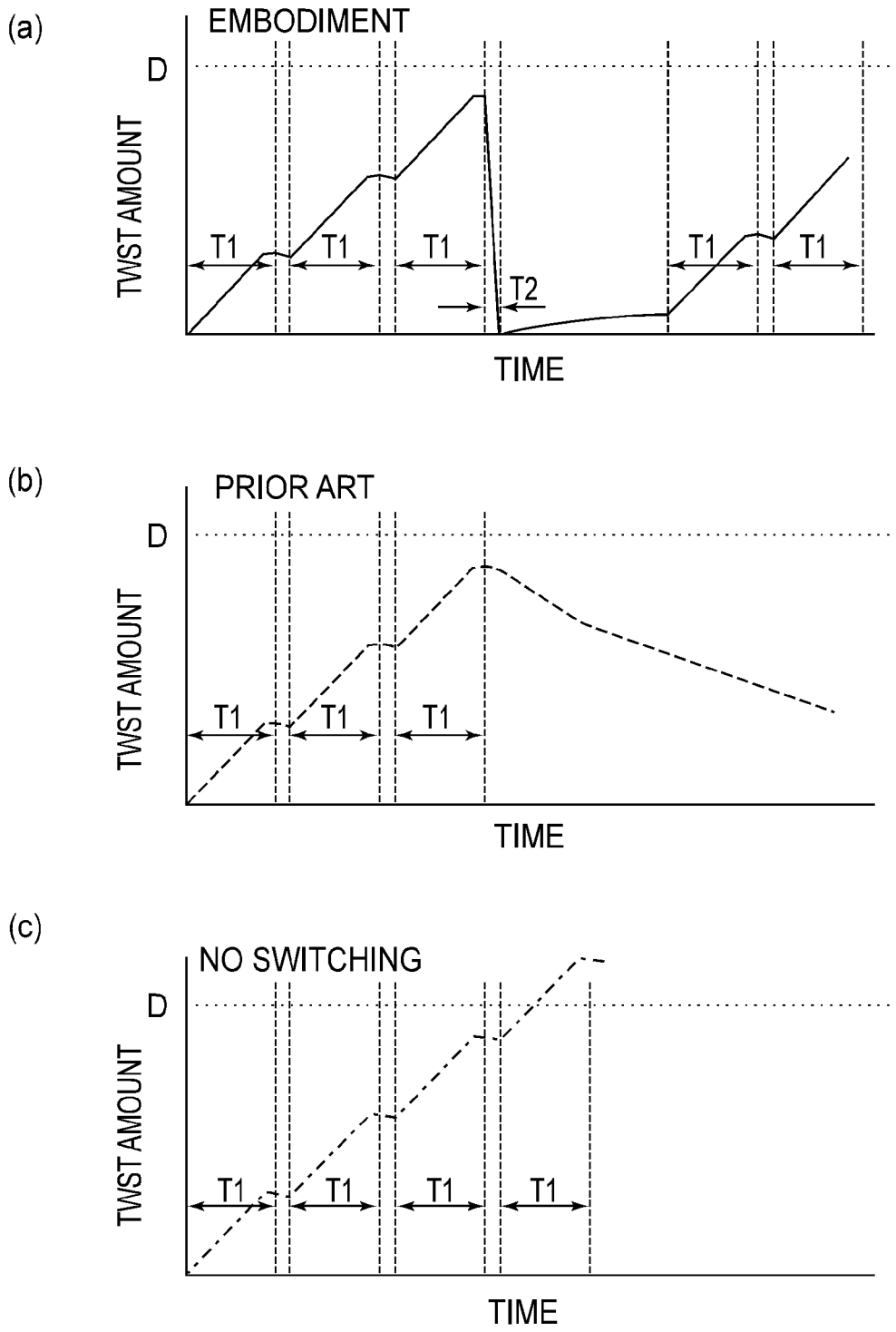
FIGS. 15(*a*), 15(*b*) and 15(*c*) are graphs which show the relationship between the length of time it takes for a sheet of the recording medium to be conveyed through the fixing device in the third embodiment, and the amount by which the heating film of the fixing device is twisted.

The image forming apparatus 100 in this embodiment, and its fixing device 25, the specifications of which are as described above, were tested under the same conditions as those under which the image forming apparatus 100 in the first embodiment was tested. FIGS. 15(*a*)-15(*c*) show the relationship between the length of time sheets P were conveyed through the fixing device 25, and the amount of twisting of the film 41. FIGS. 15(*a*) and 15(*b*) represent the apparatus in this embodiment, and conventional apparatus, respectively. FIG. 15(*c*) represents the case in which the sheet conveyance control was not carried out.

In this embodiment, the pressure removal threshold value was set to three. That is, for every third detection of the "off-center sheet conveyance", pressure is temporarily removed from the nip N of the fixing device 25, and then, pressure is reapplied to the nip N after a preset length of time. The reason why the pressure removal threshold value was set to three is as follows. That is, if four sheets P of the recording medium are successively conveyed off-center as shown in FIG. 15(*c*), which represents the case in which the sheet conveyance control is not carried out, the cumulative amount of the twisting of the film 41 reaches the aforementioned critical amount D, beyond which damage occurs to the film 41 in this embodiment.

Referring to FIGS. 15(*a*)-15(*c*), in Period T1, a sheet P of the recording medium is being conveyed off-center. In Period T2, pressure is temporarily removed from the nip N, and then, is reapplied to the nip N after a preset length of time.

In the case of the conventional image forming apparatus, for every third sheet P of the recording medium conveyed off-center, the sheet interval is extended, and therefore, the apparatus is reduced in throughput.

As will be evident from FIGS. 15(*a*)-15(*c*), the image forming apparatus 100 in this embodiment is higher in throughput, being therefore higher in productivity, than the conventional image forming apparatus.

The length of time it takes for 10 sheets P of the recording medium to be conveyed through the apparatus 100 without damaging the film 41 is roughly 150 seconds and 110 seconds for the conventional apparatus, and the apparatus in this embodiment, respectively. That is, the apparatus in this embodiment requires less time to output 10 prints than the conventional apparatus. Further, in this embodiment, the process of temporarily removing pressure from the nip N of the fixing device, and then, reapplying pressure to the nip N after a preset length of time, is carried out as the number of the sheets P of the recording medium conveyed off-center, among the sheets P conveyed through the nip N after the detection of the off-center sheet conveyance, reaches the pressure removal threshold value. Therefore, the pressure removal threshold value can be increased by employing, as the material for the film 41, such film that is less likely to be damaged by twisting. In other words, this embodiment can make an image forming apparatus higher in productivity than the first embodiment.

[Embodiment 4]

In this embodiment, a temperature sensor for detecting the temperature of the heater 42 is employed in place of the sheet width sensor 70 (70L and 70R) used as the off-center sheet conveyance detecting means for determining whether or not a sheet P of the recording medium is being conveyed off-center through the fixing device 25. The structures of the image forming apparatus 100 and fixing device 25 in this embodiment are the same as those in the first embodiment, except for the off-center sheet conveyance detecting means. Therefore, they are not going to be described here.

Figure 16:
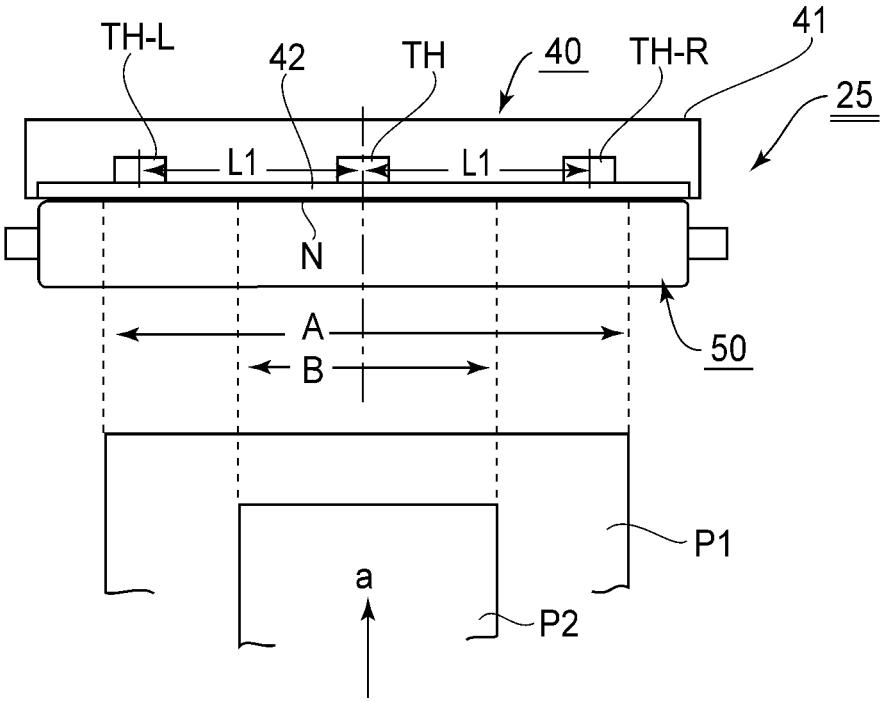
FIG. 16 is a schematic drawing of the fixing device in the fourth embodiment of the present invention, as seen from the direction from which a sheet of recording medium is introduced into the fixing device.

Referring to the schematic drawing in FIG. 16, also in this embodiment, the fixing device 25 is provided with a temperature detection element TH, which is placed in contact with the opposite surface of the heater substrate from the inward surface of the film 41 to control the heater temperature. In terms of the direction perpendicular to the recording medium conveyance direction, the temperature detection element TH is positioned so that its position roughly coincides with the centerline O of the recording medium conveyance passage.

The fixing device in this embodiment is also provided with left and right temperature detection elements TH-L and TH-R, in addition to the temperature detection element TH. The left and right temperature detection elements TH-L and TH-R are in contact with the opposite surface of the substrate of the heater 42 from the film 41, and are within the path of a normal sheet P1, being near the left and right edges, respectively, of the path of a normal sheet P1.

While a sheet P1, that is, a sheet P of the recording medium of the normal size, is conveyed through the fixing device 25, the temperature detected by the left element TH-L is the same as the temperature detected by the right element TH-R. However, while a sheet P of the recording medium is not conveyed through the area of the recording sheet passage of the fixing device 25, in which the elements TH-L or TH-R is present, that is, while a narrow sheet P2 of the recording medium is conveyed through the fixing device 25 or a sheet P of the recording medium is conveyed off-center through the fixing device 25, the portion of the heater 42, which is outside the recording medium path, increases in temperature, because it is not robbed of heat by the sheet P. This phenomenon is used to determine whether or not the sheet P in the fixing device 25 is being conveyed off-center. That is, the controller 101 uses the difference between the temperature detected by the element TH-L and that by the element TH-R to determine whether or not the sheet P in the fixing device 25 is being conveyed off-center, with reference to Table 3. The sequence carried out by the controller 101 to determine whether or not the sheet P in the fixing device 25 is being conveyed off-center is the same as that in the second embodiment, and therefore, is not going to be described here.

To summarize, the off-center sheet conveyance detecting means in this embodiment is made up of the first and second temperature detection elements TH-L and TH-R, which are positioned in contact with the lengthwise ends of the heater 42, one for one. The controller 101 controls the mechanism 60 so that pressure is temporarily removed from the nip N of the fixing device 25 in response to the difference between the temperature detected by the first temperature detection element TH-L, and the temperature detected by the second temperature detection element TH-R.

TABLE 3

| \|(TH-L temp.) − (TH-R temp.)\| | Sheet feed position |
|---|---|
| <30 deg. C. | center |
| ≥30 deg. C. | One side |

The image forming apparatus in this embodiment determines whether or not the sheet P in the fixing device is being conveyed off-center, based on the results of the temperature detection by the left and right elements TH-L and TH-R. More specifically, if the difference between the temperature detected by the left element TH-L and the temperature detected by the right element TH-R is greater than a preset value, it discharges the sheet P. Then, it temporarily removes pressure from the nip N of the fixing device, and then, reapplies the removed pressure to the nip N after a preset length of time. Then, it ends the on-going job, assuming that a printing error has occurred.

The image forming in this embodiment was tested under the same conditions as those under which the image forming apparatus in the first embodiment was tested. The results of the test proved that this embodiment was as effective as the second embodiment. Further, this embodiment allowed the off-center sheet conveyance detection threshold temperature to be changed in value according to the type of the off-center sheet conveyance detection sequence, and the strength of the film 41 against twisting. Therefore, it was capable of offering the same effects as those offered by the first and third embodiments.

As will be evident from the description of this embodiment given above, the image forming apparatus in this embodiment uses the temperature detection elements TH-L and TH-R to determine whether or not the sheet P of recording medium in the fixing device is being conveyed off-center. If it determines that the sheet P is being conveyed off-center, it temporarily removes pressure from the nip N of the fixing device to allow the film 41 to untwist itself. Therefore, it can prevent the film 41 from being damaged, without significantly reducing the apparatus 100 in productivity.

[Miscellaneous Structural Features of Apparatus]

1) The usage of an image heating apparatus in accordance with the present invention does not need to be limited to the usage as a fixing device of an image forming apparatus. For example, an image heating apparatus in accordance with the present invention can be effectively used as an apparatus for heating the fixed image on a sheet of recording medium to increase the image in gloss (apparatus for changing image in quality).

2) The heating means for heating the rotational heating means 41 does not need to be to be limited to one of the heaters 42 in the preceding embodiments of the present invention. For example, the rotational heating member 41 may be provided with a layer of heat generating resistor (which generates heat as electric current is flowed through it) so that the rotational heating means can be heated by supplying its heat generating resistor layer with electric power. Further, the rotational heating member 41 may be provided with a metallic layer (which can be made to generate heat by electromagnetic induction), and an induction coil for generating an alternating magnetic field may be placed within or outside the loop which the rotational heating member forms, so that the rotational heating member can be heated by the heat generated in the metallic layer by electromagnetic induction. In the case where the rotational heating member is provided with the heat generating resistor layer or the metallic layer, the film guide 43 is not provided with the heater 42. Thus, the inward surface of the rotational heating member slides on the film guide 43 alone.

3) The pressure applying rotational member does not need to be in the form of a roller. For example, it may be in the form an endless belt which can be driven so that it circularly moves.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 064127/2011 filed Mar. 23, 2011 which is hereby incorporated by reference.

What is claimed is:

1. An image forming apparatus comprising:

an image forming station configured to form a toner image on a recording material;

an image heating portion including a flexible heating rotatable member and a pressing rotatable member press-contacted to said heating rotatable member to form a nip, said image heating portion being effective to heat the recording material while feeding the recording material, by the nip;

a pressing state switching portion configured to switch a state of said nip between a pressing state and a released state; and recording material feeding position detector configured to detect misalignment of the recording material relative to a feeding reference position with respect to a direction perpendicular to a feeding direction of the recording material in said image forming apparatus, wherein when said recording material feeding position detector detects the misalignment, said pressing state switching portion permits said nip to feed at least one recording material in a state of the misalignment, and then said pressing state switching portion switches the nip to the released state and then switches to the pressing state.

2. An apparatus according to claim 1, wherein when a plurality of the recording materials are fed continuously, the timing of the switching from the released state to the pressing state is during an interval between successive recording materials.

3. An apparatus according to claim 1, wherein during continuous feeding of the recording materials, when said pressing state switching portion switches the nip state to the released state and then to the pressing state, an error signal is produced without resuming the feeding of the recording material.

4. An apparatus according to claim 1, wherein said heating rotatable member includes a cylindrical film and said pressing rotatable member is a pressing roller, wherein said image heating portion includes a nip formation member contactable to an inner surface of said film, and wherein said pressing roller cooperates with said nip formation member to form the nip with said film therebetween.

5. An apparatus according to claim 2, wherein the interval is longer after said recording material feeding position detector detects the misalignment than before said recording material feeding position detector detects the misalignment.

6. An apparatus according to claim 4, wherein said nip formation member includes a heater.

* * * * *